US011054189B2

(12) United States Patent
Salim Shirazy et al.

(10) Patent No.: US 11,054,189 B2
(45) Date of Patent: Jul. 6, 2021

(54) POLYMER-BASED HEAT TRANSFER DEVICE AND PROCESS FOR MANUFACTURING THE SAME

(71) Applicant: SOCPRA SCIENCES ET GENIE S.E.C., Sherbrooke (CA)

(72) Inventors: Mahmoodreza Salim Shirazy, Granby (CA); Luc G. Frechette, Sherbrooke (CA)

(73) Assignee: SOCPRA SCIENCES ET GENIE S.E.C., Sherbrooke (CA)

( * ) Notice: Subject to any disclaimer, the term of this patent is extended or adjusted under 35 U.S.C. 154(b) by 266 days.

(21) Appl. No.: 15/969,985

(22) Filed: May 3, 2018

(65) Prior Publication Data

US 2018/0320985 A1 Nov. 8, 2018

Related U.S. Application Data

(60) Provisional application No. 62/500,657, filed on May 3, 2017.

(51) Int. Cl.
*F28D 15/04* (2006.01)
*F28D 15/02* (2006.01)
(Continued)

(52) U.S. Cl.
CPC ..... *F28D 15/046* (2013.01); *F28D 15/0233* (2013.01); *F28D 15/0283* (2013.01);
(Continued)

(58) Field of Classification Search
CPC ..... F28D 15/046; F28D 15/0233; F28D 15/0283; F28F 21/062
(Continued)

(56) References Cited

U.S. PATENT DOCUMENTS 4,461,343 A * 7/1984 Token ..... F28D 15/0233 165/104.26
5,642,776 A * 7/1997 Meyer, IV ..... F28D 15/0233 165/104.26
(Continued)

FOREIGN PATENT DOCUMENTS

JP 2000018854 A * 1/2000 ..... F28D 15/046

OTHER PUBLICATIONS

Avram Bar-Cohen et al., "Two-Phase Thermal Ground Planes: Technology Development and Parametric Results", Journal of Electronic Packaging, Mar. 2015, vol. 137, pp. 010801-1 to 010801-9.
(Continued)

*Primary Examiner* — Tho V Duong
(74) *Attorney, Agent, or Firm* — Norton Rose Fulbright Canada LLP

(57) ABSTRACT

A polymer-based heat transfer device comprising a polymer-based housing having housing walls defining a working fluid chamber, a porous structure extending in the working fluid chamber from at least one of the two opposed ones of the housing walls, and a plurality of housing wall spacers, such as support posts, extending between the two housing walls to maintain the two housing walls in a spaced-apart configuration with the working fluid chamber extending in between is provided. Also described is a polymer-based heat transfer device comprising a polymer-based housing having housing walls defining a working fluid chamber and a porous structure extending in the working fluid chamber from at least one of the two opposed ones of the housing walls, and heat-conductive metal or ceramic-based foam contacting at least one of the housing walls. A process for manufacturing the polymer-based heat transfer device is provided.

12 Claims, 21 Drawing Sheets

(51) Int. Cl.
*F28F 21/06* (2006.01)
*F28D 21/00* (2006.01)

(52) U.S. Cl.
CPC .... *F28F 21/062* (2013.01); *F28D 2015/0225* (2013.01); *F28D 2021/005* (2013.01); *F28D 2021/0028* (2013.01)

(58) Field of Classification Search
USPC ..... 165/104.26
See application file for complete search history.

(56) References Cited

U.S. PATENT DOCUMENTS 6,311,769 B1 * 11/2001 Bonneville ..... H01L 23/3677 165/185
6,997,245 B2 * 2/2006 Lindemuth ..... B22F 7/004 165/104.21
8,074,706 B2 * 12/2011 Su ..... F28D 15/0233 165/104.26
9,651,312 B2 5/2017 Yang et al.
2007/0068657 A1 * 3/2007 Yamamoto ..... H05K 7/20336 165/104.26
2007/0284366 A1 * 12/2007 Ohta ..... H01L 23/373 219/553
2009/0260785 A1 * 10/2009 Wang ..... B23P 15/26 165/170
2010/0294475 A1 * 11/2010 Rush ..... F28D 15/046 165/185
2011/0017431 A1 * 1/2011 Yang ..... H01L 23/427 165/104.26

OTHER PUBLICATIONS

Ryan Lewis et al., "Thin Flexible Thermal Ground Planes: Fabrication and Scaling Characterization", Journal of Microelectromechanical Systems, 2015, 9 pages.
Christopher Oshman et al., "The Development of Polymer-Based Flat Heat Pipes", Journal of Microelectromechanical Systems, Apr. 2011, vol. 20, No. 2, pp. 410-417.
Christopher Oshman et al., "Flat flexible polymer heat pipes", Journal of Micromechanics and Microengineering, 2013, vol. 23, 015001, 6 pages.
Shou-Shing Hsieh et al., "Design, fabrication and performance tests for a polymer-based flexible flat heat pipe", Elsevier, Energy Conversion and Management, Jun. 2013, vol. 70, pp. 10-19.
Kai-Shing Yang et al. "A novel flat polymer heat pipe with thermal via for cooling electronic devices", Elsevier, Energy Conversion and Management, 2015, vol. 100, pp. 37-44.

* cited by examiner

POLYMER-BASED HEAT TRANSFER DEVICE AND PROCESS FOR MANUFACTURING THE SAME

CROSS-REFERENCE TO RELATED APPLICATIONS

This application claims priority under 35 USC § 119(e) of U.S. provisional patent application 62/500,657 filed on May 3, 2017, the specification of which is hereby incorporated by reference.

TECHNICAL FIELD

The technical field generally relates to heat transfer devices for extracting heat from a heat source with a working fluid. More particularly, the technical field relates to a polymer-based heat transfer device containing an internal working fluid, such as a heat pipe, a cold plate and a vapor chamber. It also relates to a process for manufacturing a polymer-based heat transfer device, such as a heat pipe, a cold plate and a vapor chamber.

BACKGROUND

Traditionally, high thermal conductivity metals such as copper and aluminium are used for heat transfer device fabrication, such as heat pipes, cold plates and vapor chambers. However, metal-based heat pipes are relatively expensive due to the material and manufacturing costs. Furthermore, they provide less freedom for design purposes. Typically, only cylindrical and rectangular designs can be manufactured.

There is thus a need for heat transfer devices having lower manufacturing and/or material costs and which could provide more flexibility for shape design. In view of the above, there is a need for heat transfer devices which would be able to overcome, or at least minimize, some of the above-discussed prior art concerns.

SUMMARY

According to a general aspect, there is provided a polymer-based heat transfer device. The polymer-based heat pipe comprises a polymer-based housing. The polymer-based housing has housing walls with an inner surface defining a working fluid chamber and a porous structure extending in the working fluid chamber from at least one of the housing walls, and a plurality of housing wall spacers, such as support posts, extending between two opposed ones of the housing walls to maintain the two opposed ones of the housing walls in a spaced-apart configuration with the working fluid chamber extending in between.

In an embodiment, the polymer-based housing comprises a first housing shell and a second housing shell superposed to one another and sealed together.

In an embodiment, the plurality of housing wall spacers comprises a plurality of spaced-apart support posts protruding from the inner surface of one of the housing walls towards the opposed one of the housing walls and contacting same.

In an embodiment, the polymer-based housing comprises a plurality of spaced-apart ridges protruding from at least one of the housing walls and extending substantially parallel to one another and defining inbetween a plurality of microchannels. In an embodiment, the plurality of housing wall spacers comprises the ridges which extend towards the opposed one of the housing walls and contact same.

According to another general aspect, there is provided a polymer-based heat transfer device. The polymer-based heat transfer device comprises a polymer-based housing and heat-conductive metal-based foam. The polymer-based housing has housing walls defining a working fluid chamber and a porous structure extending in the working fluid chamber from at least one of the housing walls. The heat-conductive metal-based foam contacts the at least one of the housing walls.

In an embodiment, the heat-conductive metal-based foam at least partially extends in the working fluid chamber to define the porous structure.

In an embodiment, the heat-conductive metal-based foam is at least partially embedded in the at least one of the two opposed ones of the housing walls.

In an embodiment, the porous structure comprises a plurality of microchannels defined in the at least one of the two opposed ones of the housing walls.

According to a further general aspect, there is provided a process for manufacturing a polymer-based heat transfer device. The process comprises steps of forming a first polymer-based housing shell and a second polymer-based housing shell, at least one of the polymer-based housing shells having a porous structure on at least one inner surface thereof; superposing the first housing shell and the second housing shell with one of the inner surfaces facing another one of the inner surfaces and being spaced-apart to define a working fluid chamber inbetween; at least partially peripherally sealing the first housing shell and the second housing shell together; and inserting a working fluid inside the working fluid chamber.

According to another general aspect, there is provided a polymer-based heat transfer device. The polymer-based heat transfer device comprises: a polymer-based housing having housing walls with an inner surface defining a working fluid chamber, a porous structure extending in the working fluid chamber from at least one of the housing walls, and a plurality of housing wall spacers extending between two opposed ones of the housing walls to maintain the two opposed ones of the housing walls in a spaced-apart configuration with the working fluid chamber extending in between.

In an embodiment, the polymer-based housing comprises a first housing shell and a second housing shell superposed to one another and sealed together.

In an embodiment, the plurality of housing wall spacers comprises a plurality of spaced-apart support posts protruding from the inner surface of one of the housing walls towards an opposed one of the housing walls and contacting same.

In an embodiment, the porous structure comprises a plurality of spaced-apart ridges protruding from at least one of the housing walls and extending substantially parallel to one another and defining inbetween a plurality of microchannels. The plurality of housing wall spacers can comprise the ridges which extend towards an opposed one of the housing walls and contact same. The ridges can be polymer-based ridges. The microchannels can have a width and a length ranging between about 100 and about 1000 μm and an aspect ratio (depth/width) between about 0.1 mm and about 10 mm. A bottom surface of the microchannels can be hydrophilic and a top surface of the microchannels can be hydrophobic.

In an embodiment, the housing walls have a thickness ranging between about 0.1 mm and about 5 mm.

In an embodiment, the housing wall spacers comprise a plurality of spaced-apart posts having a diameter ranging between about 0.1 mm and about 10 mm.

In an embodiment, the working fluid chamber has a height ranging between about 0.25 mm and about 5 mm.

In an embodiment, the polymer-based heat transfer device is a heat pipe and the working fluid chamber is a closed working fluid chamber.

In an embodiment, the polymer-based heat transfer device is a cold plate and the polymer-based housing comprises a working fluid inlet port and a working fluid outlet port, spaced-apart from the working fluid inlet port.

In an embodiment, the polymer-based housing comprises at least one heat-conductive insert embedded within at least one of the housing walls. The at least one heat-conductive insert can comprise a heat-conductive metal-based foam entirely embedded in the at least one of the housing walls and the porous structure can comprise a plurality of spaced-apart ridges protruding from at least one of the housing walls and extending substantially parallel to one another and defining inbetween a plurality of microchannels.

In an embodiment, the polymer-based housing is polyethylene-based.

In an embodiment, the polymer-based heat transfer device further comprises a high barrier coating, such as indium tin oxide (ITO), applied onto at least one of the inner surface of the housing walls and an outer surface of the housing walls. The polymer-based heat transfer device can further comprise an aluminium oxide layer. The polymer-based heat transfer device can further comprise a protective layer comprising at least one of SiO and $SiON_x$ or at least one of an electroplated copper thin layer and an electroplated chrome thin layer. The protective layer can be applied onto the inner surfaces of the housing walls.

In an embodiment, the inner surfaces of the housing walls are plasma-treated.

According to still another general aspect, there is provided a polymer-based heat transfer device comprising: a polymer-based housing having housing walls defining a working fluid chamber and a porous structure extending in the working fluid chamber from at least one of the housing walls; and a heat-conductive metal-based foam contacting the at least one of the housing walls.

In an embodiment, the heat-conductive metal-based foam at least partially extends in the working fluid chamber to define the porous structure.

In an embodiment, the heat-conductive metal-based foam is at least partially embedded in the at least one of the housing walls.

In an embodiment, the heat-conductive metal-based foam is entirely embedded in the at least one of the housing walls. The polymer-based housing can further comprise a plurality of housing wall spacers including a plurality of spaced-apart support posts protruding from an inner surface of one of the housing walls towards an opposed one of the housing walls and contacting same. The porous structure can comprise a plurality of spaced-apart ridges protruding from at least one of the housing walls and extending substantially parallel to one another and defining inbetween a plurality of microchannels. The ridges can extend towards an opposed one of the housing walls and contact same to define housing wall spacers. The ridges can be polymer-based ridges. The microchannels can have a width and a length ranging between about 100 and about 1000 μm and an aspect ratio (depth/width) between about 0.1 mm and about 10 mm. A bottom surface of the microchannels can be hydrophilic and a top surface of the microchannels can be hydrophobic.

In an embodiment, the porous structure comprises a plurality of microchannels defined formed superficially on in the at least one of the two opposed ones of the housing walls.

In an embodiment, the polymer-based housing comprises a first housing shell and a second housing shell superposed to one another and sealed together.

In an embodiment, the housing walls have a thickness ranging between about 0.1 mm and about 5 mm.

In an embodiment, the working fluid chamber has a height ranging between about 0.25 mm and about 5 mm.

In an embodiment, the polymer-based heat transfer device is a heat pipe and the working fluid chamber is a closed working fluid chamber.

In an embodiment, the polymer-based heat transfer device is a cold plate and the polymer-based housing comprises a working fluid inlet port and a working fluid outlet port, spaced-apart from the working fluid inlet port.

In an embodiment, the polymer-based housing comprises at least one heat-conductive insert embedded within at least one of the housing walls.

In an embodiment, the polymer-based housing is polyethylene-based.

In an embodiment, the polymer-based heat transfer device further comprises a high barrier coating, such as indium tin oxide (ITO), applied onto at least one of an inner surface of the housing walls and an outer surface of the housing walls. The polymer-based heat transfer device can further comprise an aluminium oxide layer. The polymer-based heat transfer device can further comprise a protective layer comprising at least one of SiO and $SiON_x$ or a protective layer comprising at least one of an electroplated copper thin layer and an electroplated chrome thin layer. The protective layer can applied onto inner surfaces of the housing walls.

In an embodiment, the inner surfaces of the housing walls are plasma-treated.

According to still a further general aspect, there is provided a process for manufacturing a polymer-based heat transfer device. The process comprises: forming a first polymer-based housing shell and a second polymer-based housing shell, at least one of the polymer-based housing shells having a porous structure on at least one inner surface thereof; superposing the first housing shell and the second housing shell with the inner surfaces facing another one of the inner surfaces and being spaced-apart to define a working fluid chamber inbetween; at least partially peripherally sealing the first housing shell and the second housing shells together; and inserting a working fluid inside the working fluid chamber.

In an embodiment, forming the first polymer-based housing shell and the second polymer-based housing shell comprises forming a plurality of housing wall spacers on an inner surface of at least one of the first and the second polymer-based housing shells, the housing wall spacers being configured to contact an opposed one of the inner surface when the first and the second polymer-based housing shells are superposed.

In an embodiment, forming the first polymer-based housing shell and the second polymer-based housing shell comprises forming a plurality of spaced-apart ridges protruding from an inner surface of at least one of the housing shells and extending substantially parallel to one another and defining inbetween a plurality of microchannels.

In an embodiment, the process further comprises performing at least one of an hydrophilic treatment on a bottom surface of the microchannels and an hydrophobic treatment on a top surface of the microchannels.

In an embodiment, forming the first polymer-based housing shell and the second polymer-based housing shell comprises embedding at least one heat-conductive insert within at least one of the first and the second polymer-based housing shells.

In an embodiment, embedding the at least one heat-conductive insert within at least one of the first and the second polymer-based housing shells comprises placing the heat-conductive insert inside a shell mold and injecting polymer inside the shell mold to at least partially embed the at least one heat-conductive insert inside the injected polymer.

In an embodiment, the process further comprises applying a high barrier coating onto at least one of an inner surface and an outer surface of the first and the second polymer-based housing shells.

In an embodiment, the process further comprises applying an aluminium oxide layer onto the high barrier coating.

In an embodiment, the process further comprises electroplating a thin layer of copper or chrome onto at least one of inner surfaces of the first and the second polymer-based housing shells.

In an embodiment, the process further comprises plasma-treating inner surfaces of the first and the second polymer-based housing shells.

In an embodiment, the process further comprises at least partially peripherally sealing the first housing shell and the second housing shell together comprises plastic welding or sealing through vacuum epoxy the first housing shell and the second housing shell together.

Other features and advantages of the invention will be better understood upon reading of embodiments thereof with reference to the appended drawings.

DETAILED DESCRIPTION

Figure 1:
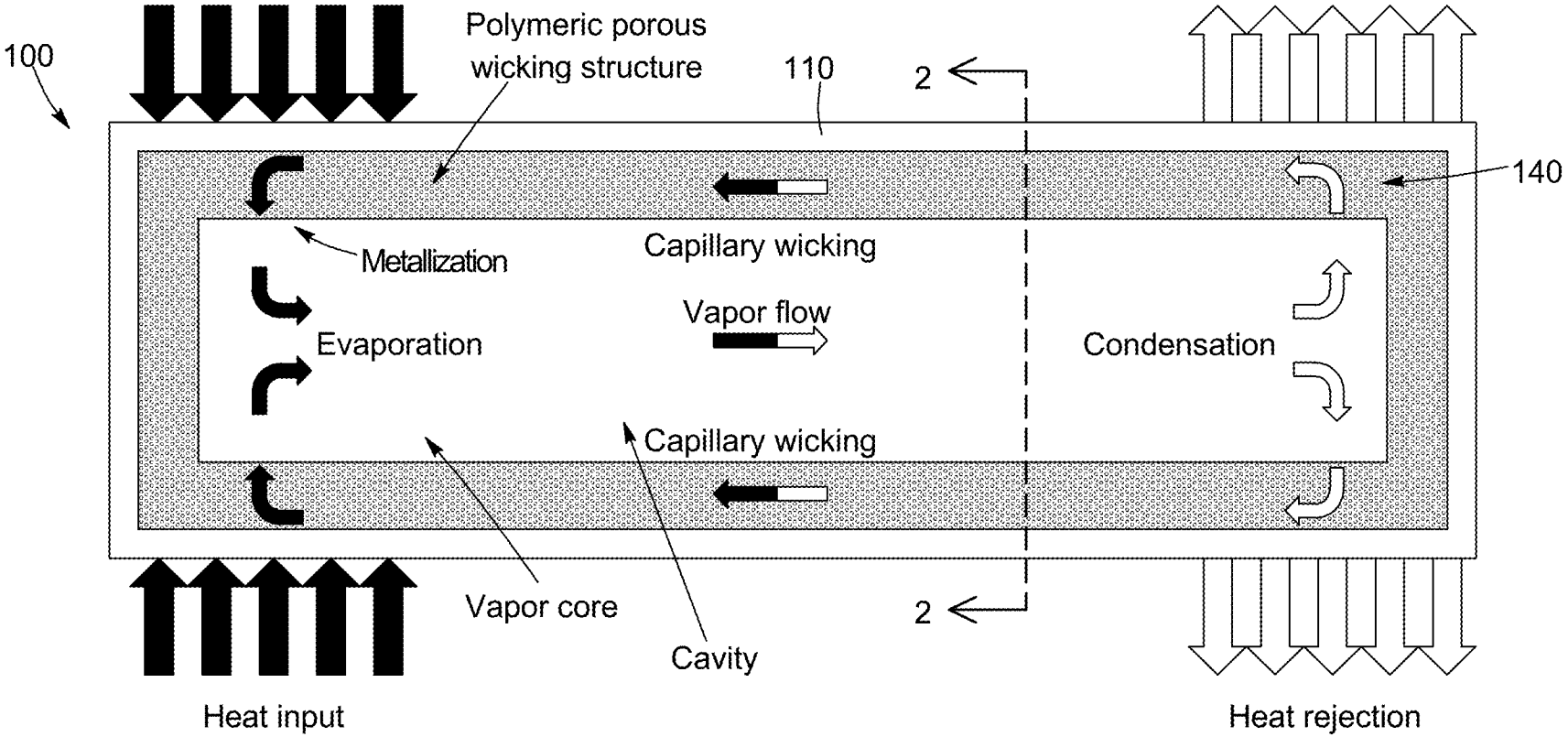
FIG. 1 is a schematic sectional representation of a polymer-based heat transfer device and, more particularly, a heat pipe in operation according to an embodiment.

In the following description, similar features in the drawings have been given similar reference numerals. In order to not unduly encumber the figures, some elements may not be indicated on some figures if they were already mentioned in preceding figures. It should also be understood herein that the elements of the drawings are not necessarily drawn to scale, and that the emphasis is instead being placed on clearly illustrating the elements and structures of the present embodiments.

Moreover, it will be appreciated that positional descriptions such as "top", "bottom", "under", "left", "right", "front", "rear", "adjacent" and "opposite" and the like should, unless otherwise indicated, be taken in the context of the figures and should not be considered limiting.

Furthermore, it is to be understood that the invention can be carried out or practiced in various ways and that the invention can be implemented in embodiments other than the ones outlined in the description above.

It is to be understood that, where the claims or specification refer to "a" or "an" element, such reference is not be construed that there is only one of that element.

It is to be understood that, where the specification states that a component, feature, structure, or characteristic "may", "might", "can" or "could" be included, that particular component, feature, structure, or characteristic is not required to be included.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

Figure 12:
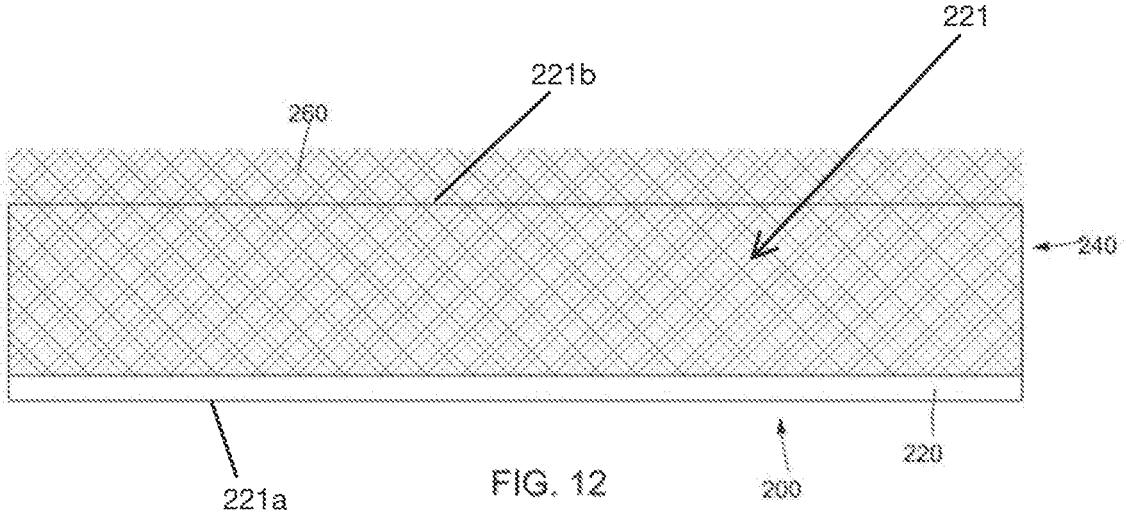
FIG. 12 is a schematic sectional view of a section of a housing wall of a polymer-based heat transfer device and, more particularly, a heat pipe according to a possible embodiment, with heat-conductive metal-based foam partially embedded in the housing wall and partially extending outwardly from the housing wall.
Figure 12A:
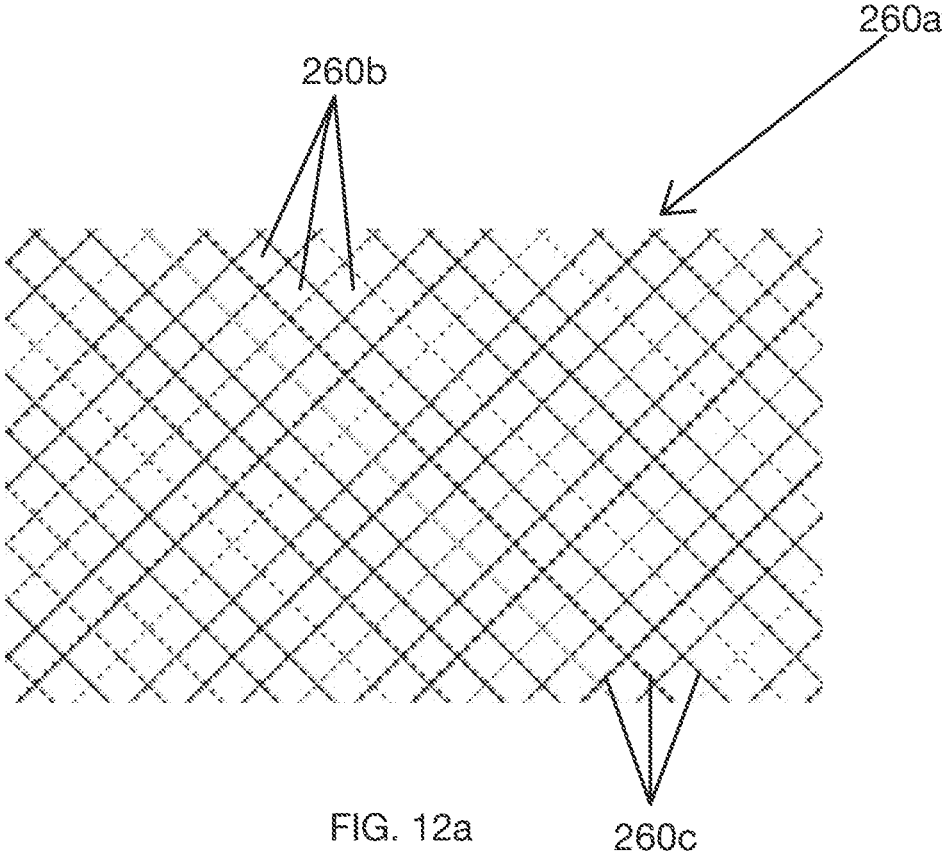
FIG. 12*a* is an enlarged view of a portion of FIG. 12.

Generally described, the present disclosure concerns heat transfer devices such as heat pipes, cold plates, and vapor chambers for extracting heat from a heat source with a working fluid, as well as a process for manufacturing the heat transfer devices, such as heat pipes, cold plates, and vapor chambers. The heat transfer device is of the type of polymer-based heat transfer device comprising relative low thermal conductivity (in comparison to metal-based heat transfer device). More particularly, a housing of the heat transfer device is mainly constructed of plastics, such as low cost commercially available polymers, including high-density polyethylene (HDPE). Since polymers are typically cheaper than metal, this type of polymer-based heat pipe may be useful, for example, for less thermally intensive applications, wherein low manufacturing costs are non-negligible and/or relatively low-weight heat transfer devices are suitable. As will be discussed below, a wall of the housing may include a heat-conductive insert made of a second material having a greater thermal conductivity than that of the first material. The wall made of the first material and having the heat-conductive insert embedded therein therefore has a greater thermal conductivity than if the wall were made solely of the first material without the heat-conductive insert. This is illustrated in FIGS. 12 and 12*a*.

Broadly described, the polymer-based heat transfer device (hereinafter referred to as "heat transfer device" unless specified otherwise) includes a working fluid chamber of a relatively small height at least partially delimited by a porous structure fabricated, formed or added on an inner surface of at least one housing wall of the heat transfer device. The working fluid chamber, which can be a closed working fluid chamber, including an at least partially empty space defined by the porous structure, is typically filled (or at least partially filled) with a working fluid, such as water.

Figure 2:
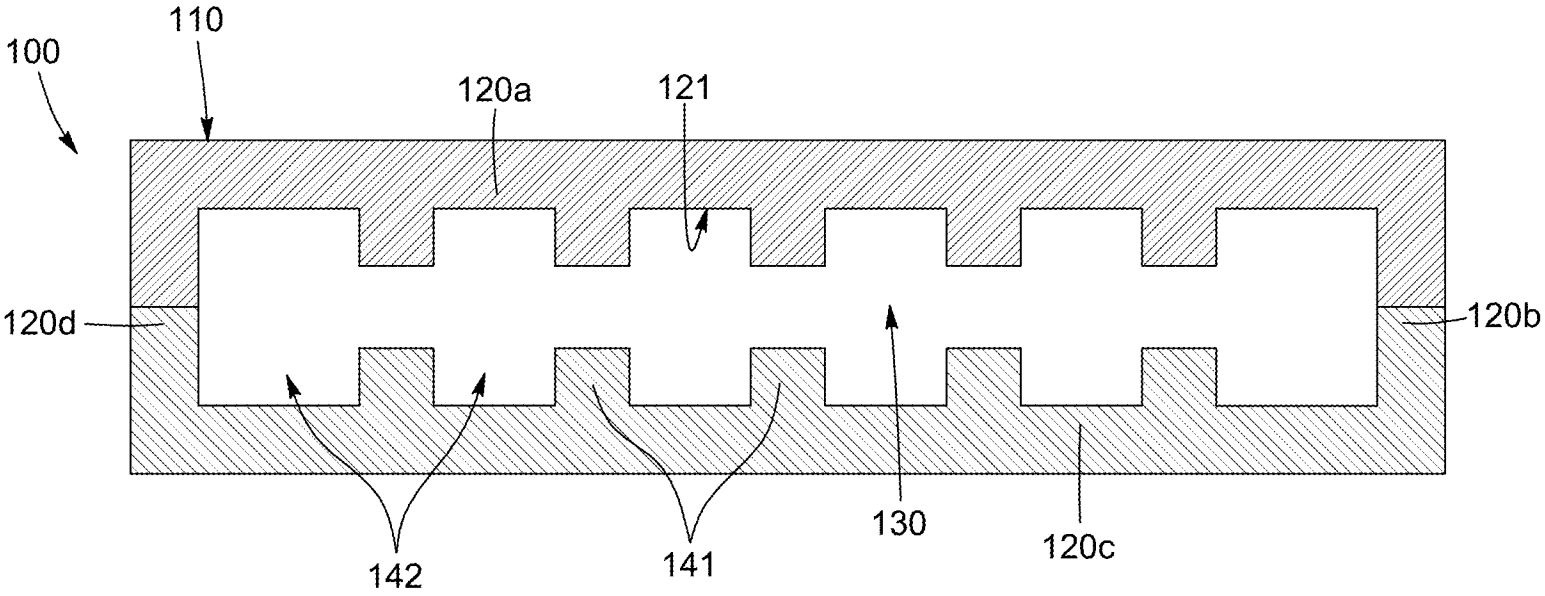
FIG. 2 is a schematic sectional view of the polymer-based heat transfer device of FIG. 1 and taken along line 2-2 on FIG. 1, and more particularly, a heat pipe according to a possible embodiment wherein inner surfaces of a polymer-based housing include a wicking structure as a porous structure.
Figure 3:
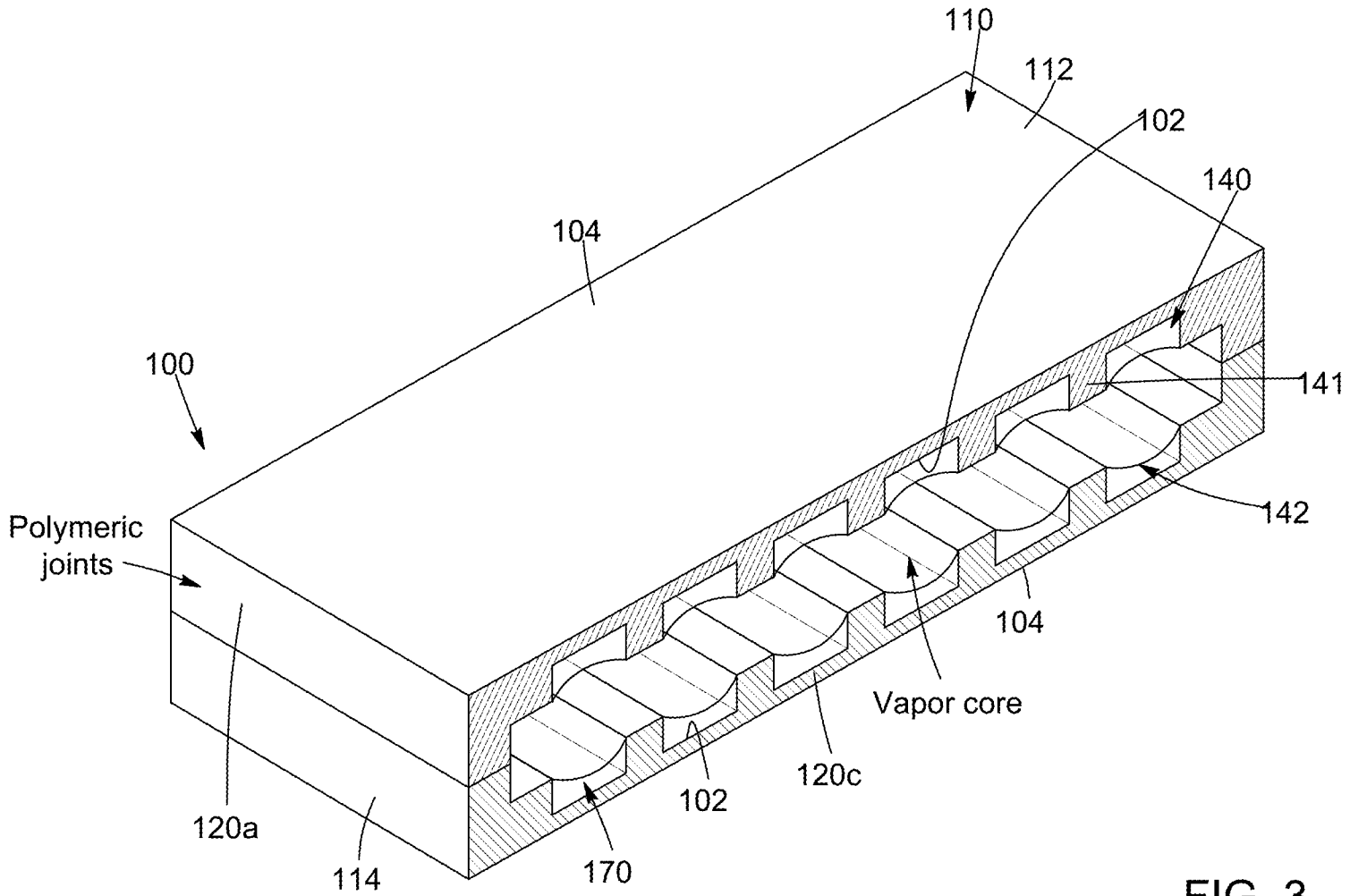
FIG. 3 is a schematic top perspective view, sectioned, of the polymer-based heat pipe shown in FIG. 2.
Figures 4, 5:
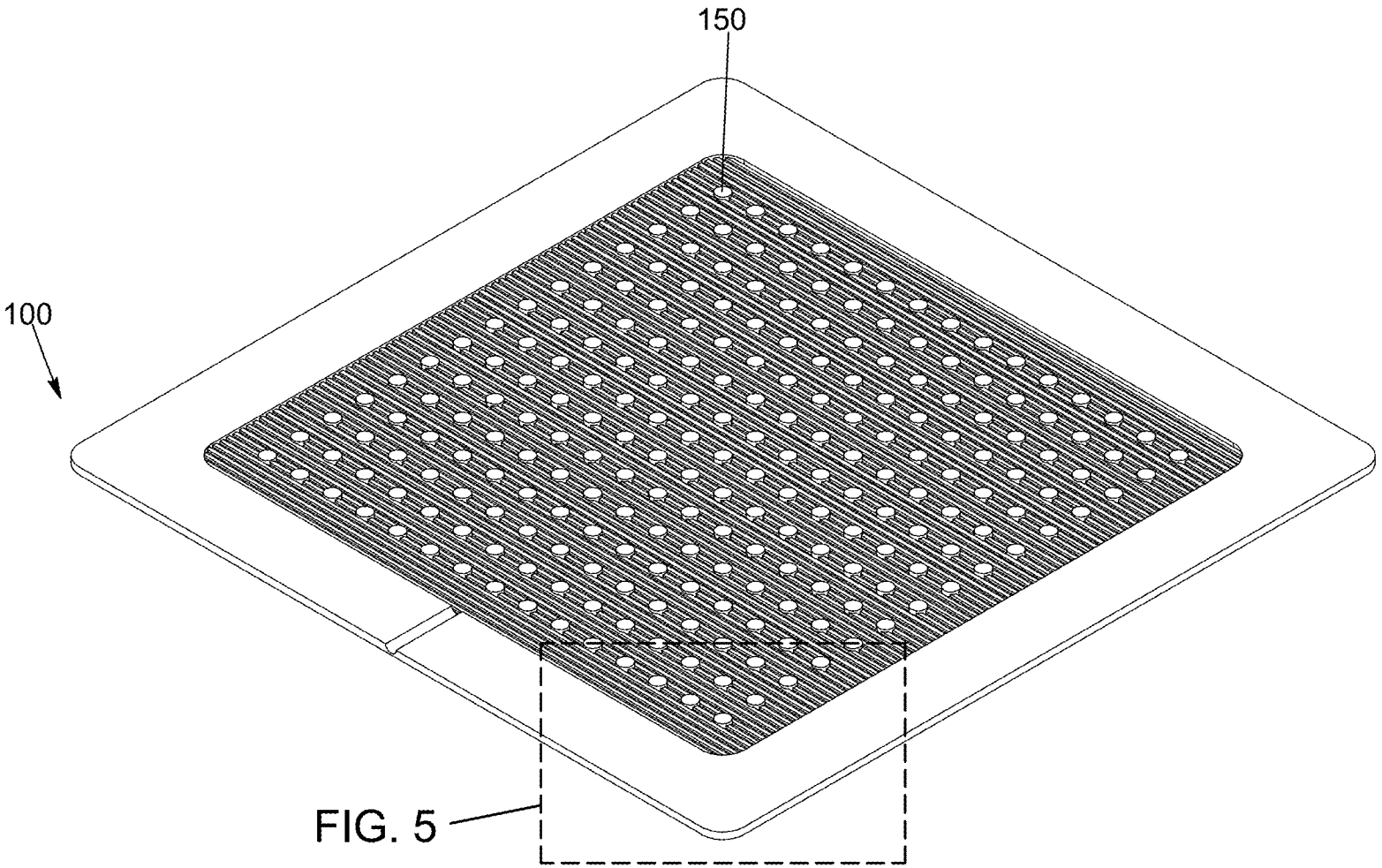
FIG. 4 is a schematic top perspective view of a housing shell of a polymer-based heat pipe according to another possible embodiment, including a plurality of spaced-apart support posts configured to protrude from an inner surface of the housing shell and in a working fluid chamber of the polymer-based heat pipe.
FIG. 5 is a top perspective view, enlarged, of a section of the housing shell of the polymer-based heat pipe shown in FIG. 4.
Figure 5:
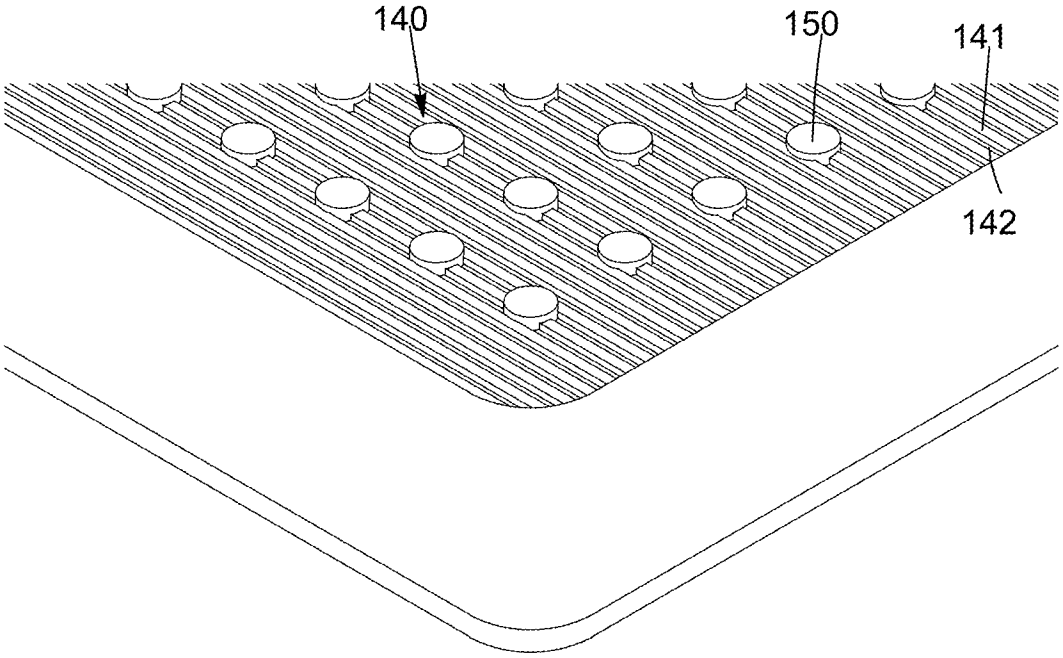

An implementation of the polymer-based heat transfer device will be described in reference to FIGS. 1-3 showing a heat pipe 100, as heat transfer device. The heat pipe 100 includes a housing 110 having walls enclosing a working fluid chamber 130 also referred to as a vapor chamber in some embodiments. The housing 110 includes a porous structure 140 provided on at least one of two opposed ones of walls of the housing 110 and extending in the working fluid chamber 130. The porous structure 140 includes a structure having channels through which a fluid can flow. It can include a porous structure having small communicating pores defining together channels through which the working fluid can flow, such as metallic foam structures, and/or a porous structure in which elongated and substantially linear microchannels are defined either superficially or internally.

In FIG. 1, the heat pipe 100 in shown in operation. One end or side of the polymer-based heat transfer device 100 and, more particularly, a heat pipe, is placed close to a heat source, while another end or side of the polymer-based heat pipe 100 is configured as a heat sink for heat rejection. In a vapor chamber configuration, the heat source is located across an area on one of the walls, while the heat sink 100 is located elsewhere on the same wall or on the opposite wall. Evaporation and condensation occur at the areas located close to the heat source and the heat sink, respectively. After evaporation of the working fluid from one end, the working fluid, in its vapour phase, flows within the working fluid chamber 130 towards the heat sink, where its condenses back to its original liquid phase. After its evaporation, the evaporated fluid leaves an empty space behind that is to be filled with the working fluid remaining in the porous structure by capillarity.

In an implementation for a heat pipe, the porous structure comprises a wicking structure. A wicking structure is a structure including a meniscus area in which a capillary pressure is develop at a liquid-vapor interface in a manner such that the liquid can flow therein. In addition to being a porous structure, a wicking structure creates capillary pressure through the meniscus area.

According to one possible embodiment, the polymer-based housing may be formed from high density polyethylene (HDPE). Alternatively, the polymer-based housing can be formed from polyethylene of different density, crystal structure, molecular weight, and/or branching. For example, and without being limitative, the polymer-based housing can be formed from ultra-high-molecular-weight polyethylene, ultra-low-molecular-weight polyethylene, cross-linked polyethylene, or any other polyethylene-based material having the appropriate properties for the targeted applications. It will be understood that the polymer-based housing could also be formed from polymer, thermoplastic, acrylic, or any suitable materials having the required mechanical, electrical and/or thermal properties.

In an implementation, the polymer forming the polymer-based housing may include a flame-retardant agent. In an embodiment, the flame-retardant agent can be combined with the polymer to provide an extra safety role in case of fire. For instance, and without being limitative, an organophosphorus-based flame retardant, such as triphenyl phosphate (TPP), can be combined with the polymer. For instance, during thermal runaway of the lithium-ion battery, the polymer-based housing of the heat transfer device would melt due to increased temperature and the flame-retardant agent will be released, thus effectively suppressing the combustion of the highly flammable electrolytes in the Li-ion battery.

In a non-limitative embodiment, the housing walls may have a thickness ranging from about 0.1 to about 5 mm and their inner surfaces may be spaced-apart from one another to define a working fluid chamber having a height ranging between about 0.25 mm and about 5 mm. In accordance with a first aspect and referring to FIGS. 2 and 3, an embodiment of a polymer-based heat pipe 100 is shown.

The polymer-based heat pipe 100 comprises a polymer-based housing 110 having housing walls 120*a*, 120*b*, 120*c* and 120*d*. The housing walls 120*a*, 120*b*, 120*c* and 120*d* have an inner surface 121 defining a closed working fluid chamber 130. In the illustrated variant, the polymer-based housing 110 has a porous structure provided on two opposed ones of the housing walls 120*a*, 120*c*. Alternatively, the polymer-based housing 110 can have a porous structure and, more particularly, a wicking structure provided on at least one of the two opposed ones of the housing walls 120*a*, 120*c*. The porous structure 140 is located in the closed working fluid chamber 130. In the embodiment shown in FIGS. 2 and 3, the wicking structure 140 includes a plurality of elongated ridges 141 (or fins), extending substantially parallel to one another and protruding in the closed working fluid chamber 130 from the housing walls 120*a*, 120*c*, and defining inbetween a plurality of microchannels 142. In the embodiment shown, the ridges 141 and microchannels 142 extend substantially linearly within the working fluid chamber 130. The elongated ridges 141 and the microchannels 142 extend from an evaporation area to a condensation area of the polymer-based heat pipe 100. The microchannels 142 define fluid paths between the evaporation area to the condensation area in which may flow a working fluid 170, between the condensation area towards the evaporation area. Each one of the plurality of parallel microchannels 142 can have a predetermined aspect ratio to determine a profile of the wicking structure 140. The aspect ratio may be determined so as to provide a profile that may be, for example, and without being limitative, rectangular or square. Alternatively, the aspect ratio could be determined so as to obtain a parabolic, semicircular, U-shaped V-shaped profile. As it will be understood, the wicking structure 140 could be of any shape and or dimension, and may be, for example, channel-shaped and micrometric (with a dimension below about 1 mm). The wicking structure 140 can be formed of continuous ridges or discontinuous fins. The space between fins forms a two-dimensional array of interconnected microchannels.

In the embodiment shown in FIGS. 1 to 8, the wicking structure is polymeric-based (or a polymeric wicking structure). However, as will be described in more details below, in alternative embodiments, the wicking structure can be metal-based. According to one possible embodiment, the porous structure 140 may be formed directly into the two opposed ones of the housing wall 120*a*, 120*c*. Alternatively, the porous structure 140 could be progressively added (such as by additive manufacturing) or mounted onto the two opposed ones of the housing wall 120*a*, 120*c*. The microchannels 142 can be etched or machined on the inner surface 121 of the housing walls 120*a*, 120*c* to create an enhanced heat exchange surface with the working fluid 170. In this case, the microchannels 142 and the housing walls 120*a*, 120*c* are one single piece. In an embodiment, the housing walls can include a heat-conductive insert embedded therein and extending at least partially under the microchannels 142, as will be described in more details below.

In the vapor chamber configuration, porous structures located on the two opposed housing walls can be connected to allow liquid to move from one housing wall to the other housing wall by capillarity. This capillary connection can be implemented on the other housing walls 120*b* and 120*d*, or at other locations along the housing walls 120*a* and 120*c*.

According to one possible embodiment, the porous structure 140 may comprise a plurality of microchannels of approximately 250 μm×300 μm (depth×width), corresponding to an aspect ratio (depth/width) of approximately 0.8. As it will be understood, dimensions of the microchannels can be adjusted to the needs of one skilled in the art and so as to obtain an aspect ratio suitable for a given application. For instance, the dimensions of the microchannels may be comprised between 100 and 1000 μm, and the aspect ratio (depth/width) may be comprised between 0.1 to 10.

Referring to FIGS. 4 to 8, the polymer-based heat pipe 100 may further comprise a plurality of spaced-apart housing wall spacers embodied as support posts 150 protruding from the inner surface 121 of at least one of the housing wall 120*a*, 120*c*. The support posts 150 extend between the two opposed ones of the housing walls 120*a*, 120*c* and provide support to the polymer-based heat pipe 100, more particularly by maintaining the two opposed ones of the housing walls 120*a*, 120*c* in a spaced-apart configuration to allow a flow of the working fluid 170 in the closed working fluid chamber 130. Optionally, the plurality of support posts 150 may be uniformly distributed across the surface of the two opposed ones of the housing walls 120*a*, 120*c*. Alternatively, the plurality of support posts 150 could be nonuniformly distributed across the surface of the two opposed ones of the housing walls 120*a*, 120*c*, and could be, for example, found in greater density near the center, the periphery and/or any other regions of the polymer-based heat pipe 100 where a support post may be useful to increase resistance to pressure differences and external mechanical loads. Yet optionally, each one of the plurality of support posts 150 may have a right circular cylindrical body. Alternatively, each one of the plurality of support posts 150 could have a body of various geometrical configurations and could have a cubic, parallelepipedal, pyramidal, or any other shapes useful to one skilled in the art. Alternatively, the support posts can integrate narrow sections to act as a capillary path between opposed housing walls 120*a* and 120*c*.

According to one possible embodiment, each of the support posts 150 has a substantially circular cross-section and a diameter of about 1 mm. It will be understood that the shape and size may vary according to one's need. For example, the diameter of each of the support posts 150 may, for instance, and without being limitative, be comprised between about 0.1 to about 10 mm.

In an alternative embodiment (not shown), the housing wall spacers can also take an elongated shape, such as a wall or ridge.

Figure 6:
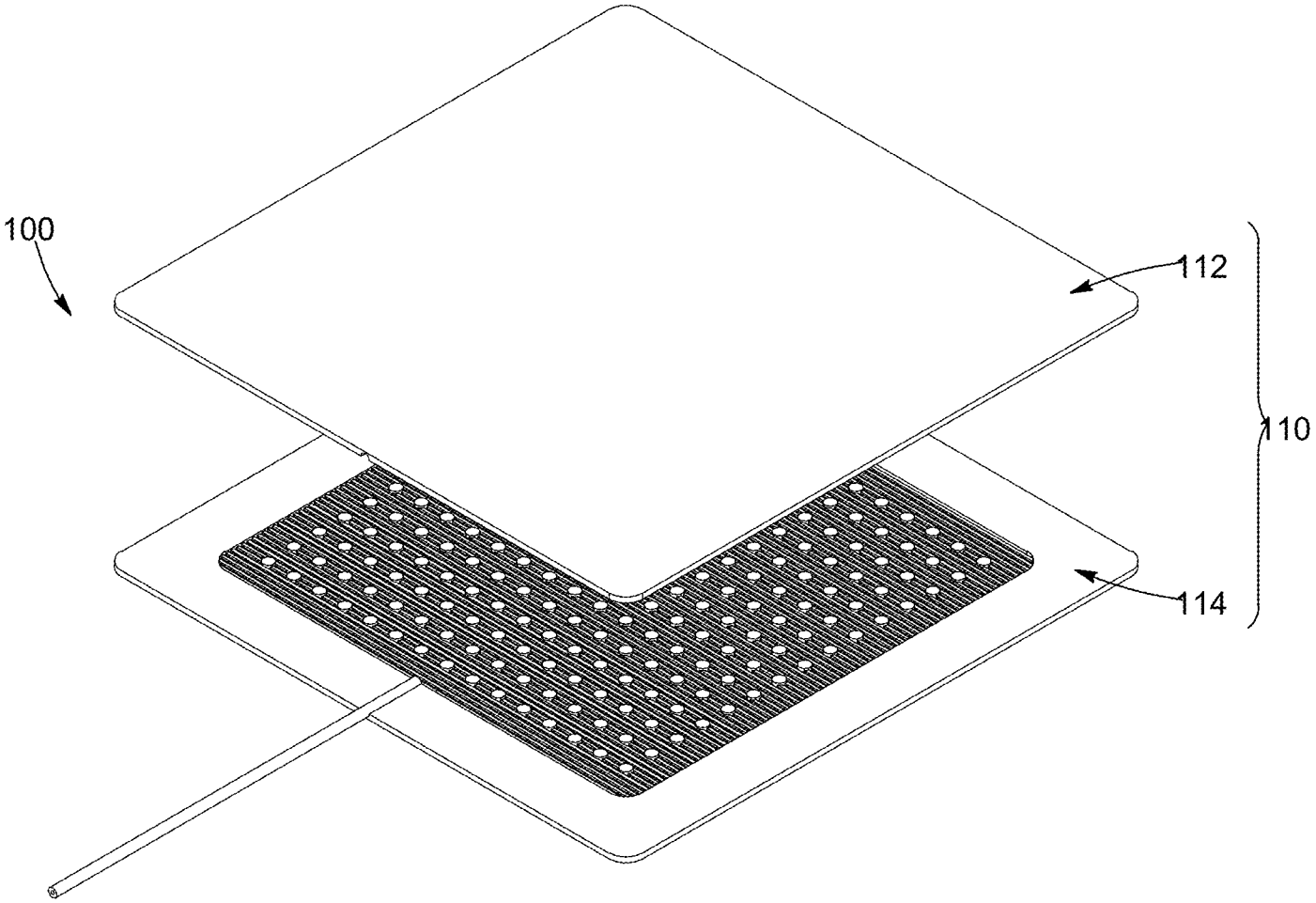
FIG. 6 is an exploded top perspective view of the polymer-based heat pipe including the housing shell shown in FIG. 4.
Figure 7:
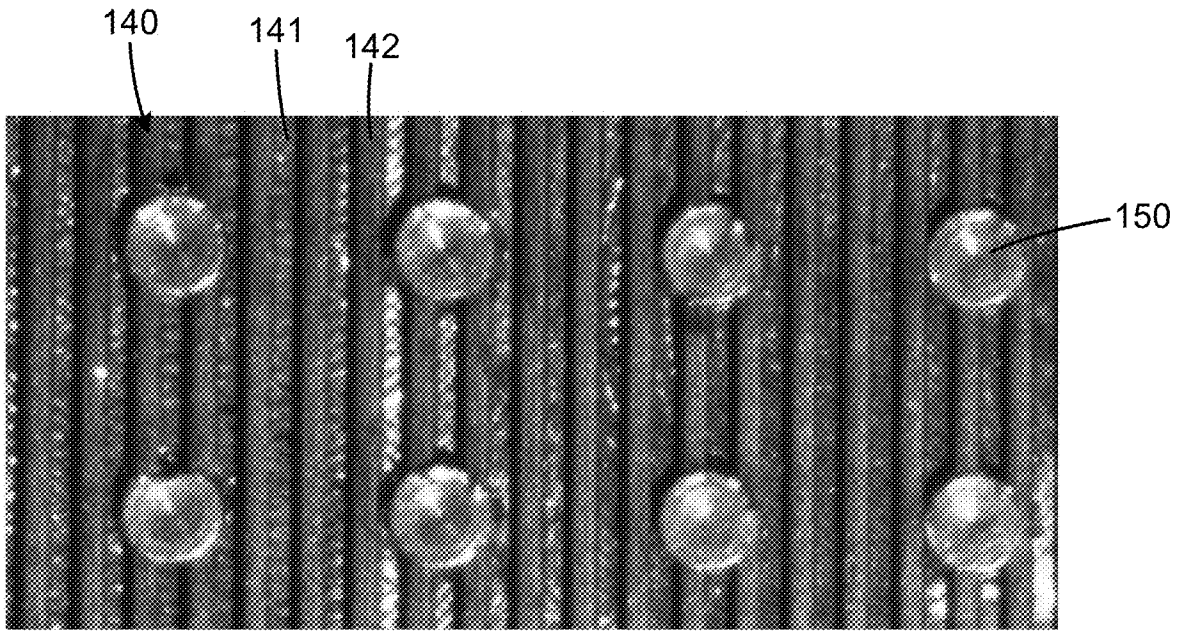
FIG. 7 is a photograph of a section of the housing shell fabricated in accordance with the embodiment shown in FIG. 4.
Figure 8:
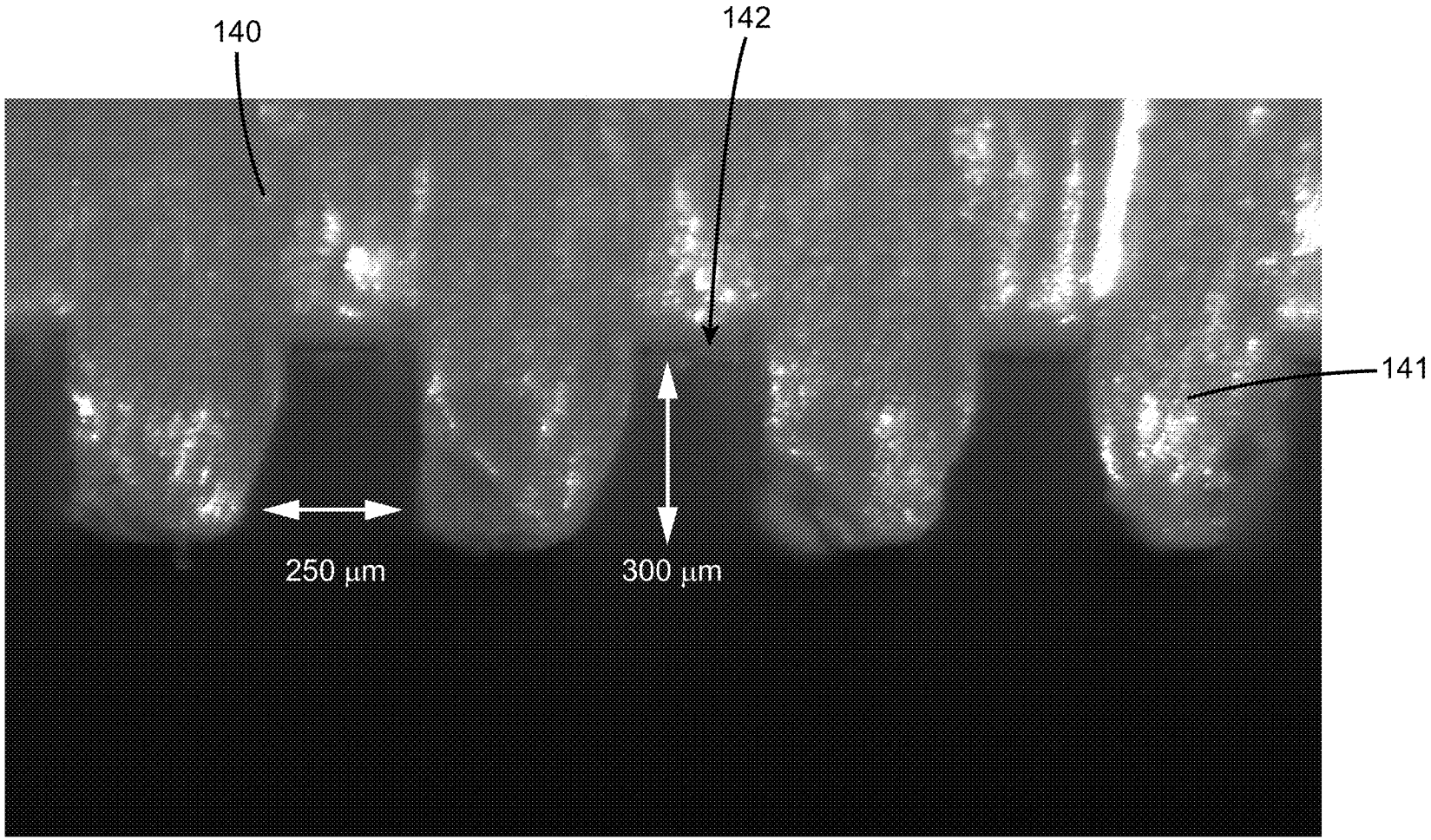
FIG. 8 is a microscopic view of a wicking structure of a polymer-based heat pipe fabricated in accordance with the embodiment shown in FIG. 2.

As shown in FIGS. 3 and 6, according to one possible embodiment, the polymer-based housing 110 may comprise a first housing shell 112 and a second housing shell 114 superposed to one another and sealed together. Optionally, the polymer-based housing 110 may be formed of the first and second housing shells 112, 114, each defining an inner side 102 and an outer side 104 of the polymer-based heat pipe 100. Yet optionally, at least one of the first and second housing shells 112, 114 may comprise the porous structure 140 thereon. As shown in the embodiments of FIGS. 2 to 8, both the first and second housing shells 112, 114 comprise the porous structure 140, and the porous structure 140 is provided on the inner side 102 of the housing walls 120*a*, 120*c* of the polymer-based heat pipe 100. Alternatively, the polymer-based housing 110 may comprise a plurality of housing shells, i.e. two or more, that could be assembled together to form the polymer-based heat pipe 100.

Figure 9:
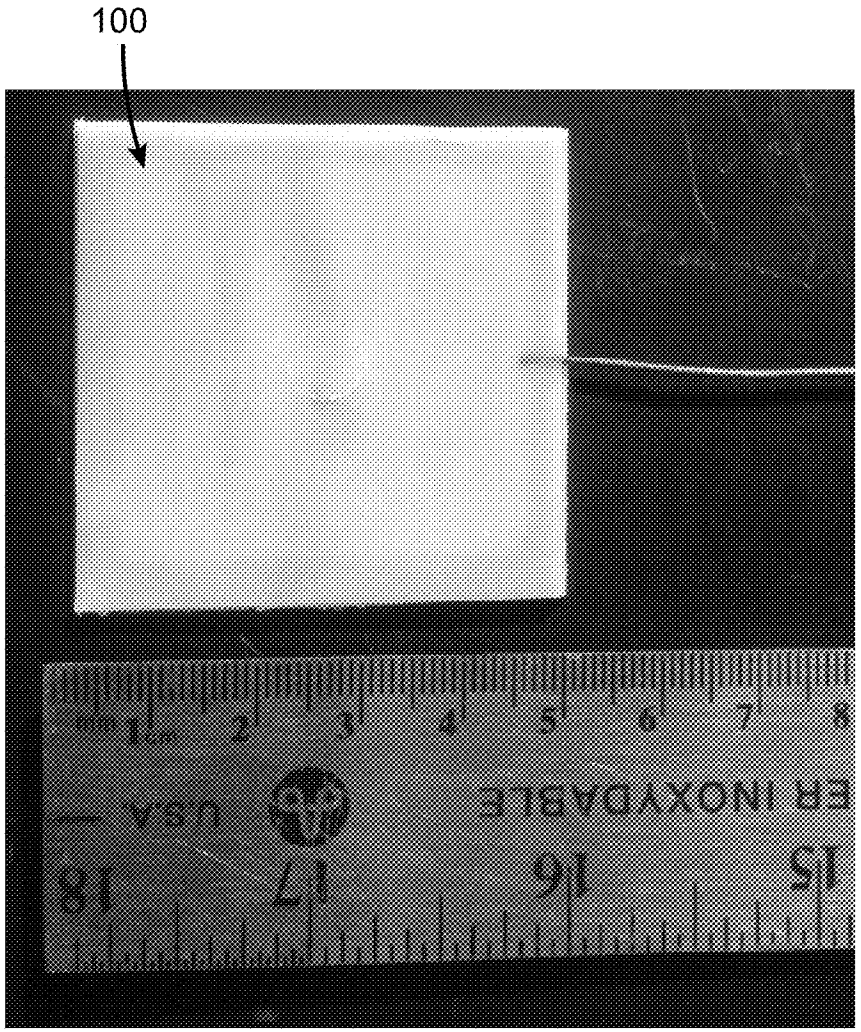
FIG. 9 is a photograph showing a top view of a polymer-based heat transfer device and, more particularly, a heat pipe according to a possible embodiment.

In one embodiment and referring to FIG. 9, the first and second housing shells 112, 114 may be assembled in a configuration in which the porous structure 140 formed on each of the first and second housing shells 112, 114 face each other. In this configuration, the porous structure 140 formed on the first housing shell 112 faces the porous structure 140 formed on the second housing shell 114 and the support posts 150 maintain a gap within the working fluid chamber 130. The gap between the first and second housing shells 112, 114, as such, may be configured as a "vapour core" between the two mating shells, in which the working fluid 170 can evaporate from one area, channel through the vapour core and condense back to another area. For example, when the first and second housing shells 112, 114 are assembled, the closed polymeric chamber may have a height ranging from about 0.25 to about 5 mm.

The polymer-based heat pipe 100 may, for example, and without being limitative, have a square shape and centimetric dimension (e.g. 5 cm×5 cm×0.1 cm). It will be understood by one skilled in the art that the polymer-based heat pipe 100 may have different size, dimensions and shape, according to the aimed application. In addition to taking planar shape, the heat pipe can be three-dimensional (3D), with bends and curvature. In this embodiment, the two or more shells have a corresponding 3D shape so that, when assembled, their inner surfaces are facing each other to form the vapor core.

According to one embodiment, the working fluid 170 may be water. Alternatively, the working fluid 170 could be, for example, refrigerant (e.g. R134a), ammonia, methanol or acetone. It will be understood that the working fluid 170 is selected so as to be compatible with the material forming the porous structure 140, and may, accordingly, vary from one application to another.

Referring to FIGS. 10 to 13 two other embodiments of a polymer-based heat transfer device and, more particularly, heat pipes 200, or sections thereof, are shown. As in the embodiment described above, the polymer-based heat pipe 200 comprises a polymer-based housing 210 having housing walls 220*a*, 220*b*, 220*c* and 220*d* wherein the housing walls 200*a-d* define a closed working fluid chamber 230. As in the above-described embodiment, the polymer-based housing 20 has a porous structure 240. For example, the housing walls 220*a*, 220*b*, 220*c* and 220*d* may have a thickness ranging from about 0.1 to about 5 mm. As illustrated, the housing walls 220*a*, 220*b*, 220*c* and 220*d* have a thickness of about 1 mm. In both embodiments, the porous structure 240 extends at least partially in the closed working fluid chamber 230, from the housing walls 220*a*, 220*c*. The polymer-based heat pipe 200 further comprises a heat-conductive insert embedded within the housing walls 220*a*, 220*c*. In the embodiment shown, the heat-conductive insert is a metal-based foam 260. These embodiments can be suitable for applications that require thermally intensive applications, providing higher wall thermal conductivity, and structural rigidity. Embedding heat-conductive metal into the housing walls 220*a-d* increases the thermal conductivity of the polymer-based heat pipe 200 making them suitable for thermally intensive applications while maintaining the advantages of the polymer-based heat pipes, including their relatively low costs and light weight. In fact, polymer-based heat pipes including at least partially embedded heat-conductive metal into the housing walls 220*a-d* require less metal than metal-based heat pipes.

Figure 10:
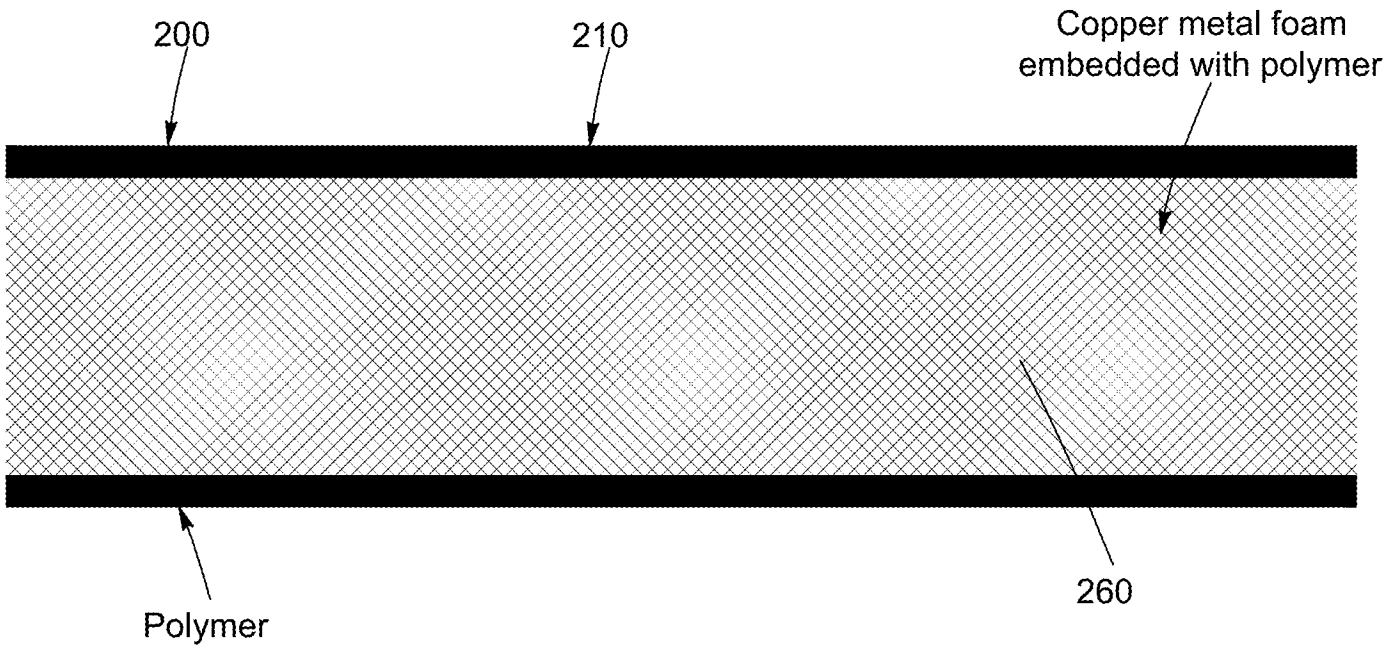
FIG. 10 is a schematic sectional view of a section of a housing wall of a polymer-based heat transfer device and, more particularly, a heat pipe according to another possible embodiment, with heat-conductive metal-based foam embedded in the housing wall.
Figure 11:
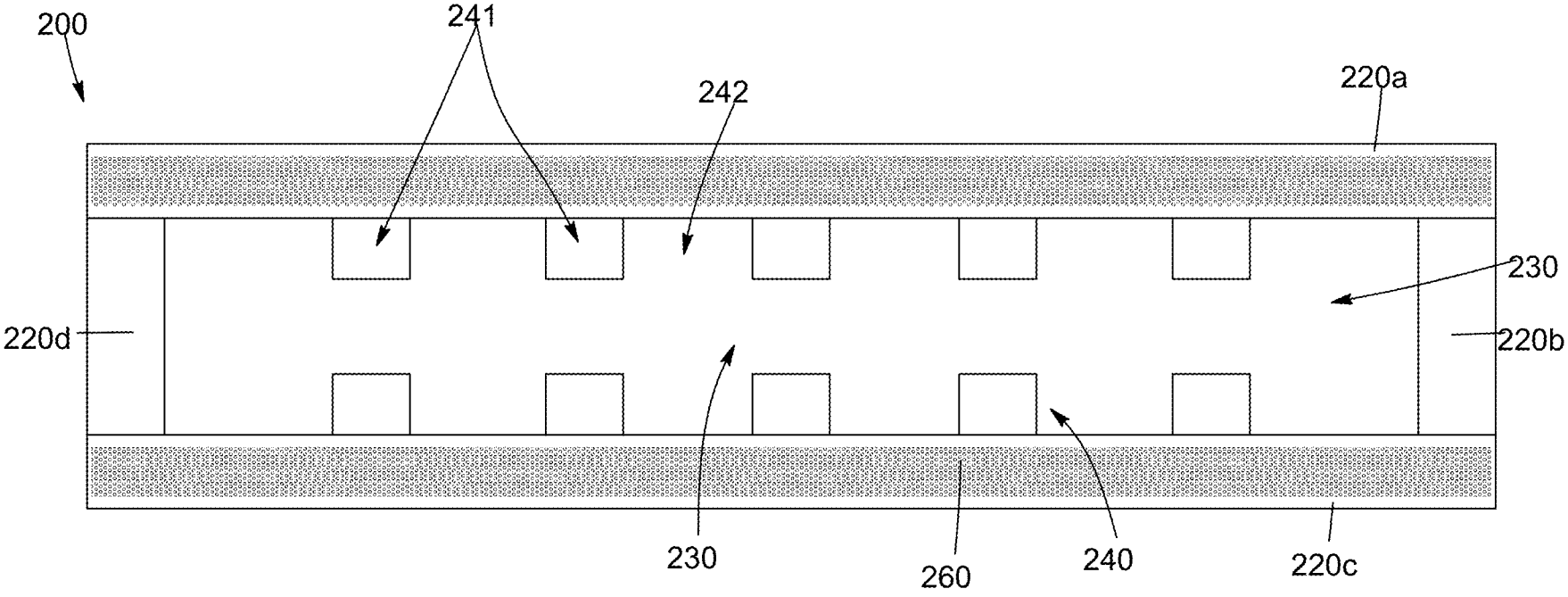
FIG. 11 is a schematic sectional view of a polymer-based heat pipe including the housing wall shown in FIG. 10, in accordance with an embodiment.

In a first one of the two embodiments, shown in FIGS. 10 and 11, the two opposed ones of the housing walls 220*a* include heat-conductive metal-based foam 260 completely embedded within the housing walls 220*a*, 220*c* and acting as a heat-conductive insert. In a second one of the two embodiments, shown in FIGS. 12 and 13, the heat-conductive metal-based foam 260 extends at least partially in the closed working fluid chamber 230 and defines the porous structure 240.

Thus, in both embodiments, the heat-conductive insert, depicted here as the metal-based foam 260, is at least partially embedded within the housing walls 220*a*, 220*c*. That is, in the embodiment shown, the wall 220 has a wall body 221 having an outer face 221*a* and an inner face 221*b*. The inner face 221*b* faces the working fluid chamber 230. The wall body 221 is made of a first material that includes a polymer. As illustrated, a portion of the heat-conductive metal-based foam 260 is contained within the wall body 221 between the outer and inner faces 221*a*, 221*b*. In the illustrated embodiment, the heat-conductive metal-based foam 260 protrudes from the inner face 221*b* into the working fluid chamber 230. It may alternatively be entirely embedded into the wall body 221 between the faces 221*a*. 221*b*. At least partially embedding heat-conductive material, such as heat-conductive metal-based foam, having a higher heat conductivity than polymer, enhances the thermal conductivity of the polymer-based heat pipe 200. Furthermore, if the embedded material is stiffer than the polymer defining the housing, such as heat-conductive metal-based foam, the at least partially embedded heat-conductive material further enhances the structural rigidity of the polymer-based heat pipe 200. The heat-conductive material can be chosen to have a similar thermal expansion coefficient as the heat source to which it will be coupled to allow a solid (welded) interface between the heat source and the heat-conductive material. For example, and without being limitative, the heat-conductive material could be: copper, steel, titanium, aluminum, silicon, germanium, superalloys, or any other materials having the required properties listed above. Alternatively, the housing walls 220 *a-d* can comprise other structural elements to provide more rigidity to the polymer-based heat pipe 200. For highest rigidity and wall thermal conductivity, solid blocks or sheets of metal or ceramic can be embedded in the housing walls 220 *a-d*.

The heat-conductive metal-based foam 260 may be formed from copper foam. Alternatively, the heat-conductive metal-based foam 260 may comprise metal foam, alloy foam and any other porous materials having the required porosity and in which may be injected a polymer. It will be understood that the heat-conductive metal-based foam 260 is embodied by a material or a combination of material which presents the required thermal, electrical and mechanical properties. As shown more particularly in FIG. 12*a*, the heat-conductive insert, shown here as the metal-based foam 260, has a structure 260*a* defining porosities or pores 260*b* between structural members 260*c* of the structures 260*a*. The porosities 260*b* are filled with the polymer. As shown in FIGS. 12-12*a*, the porosities 260*b* of a portion of the foam 260 that is embedded within the wall body 221 containing the polymer whereas the porosities 260*b* of another portion of the foam 260 that extends beyond the inner face 221*b* of the wall body 221 are substantially free of the polymer.

The embodiment shown in FIGS. 10 and 11 will now be described in further details, wherein the porous structure 240 comprises a plurality of elongated ridges 241, extending substantially parallel to one another, and defining inbetween a plurality of microchannels 242, similar to the microchannels 140 described above. Thus, the embedded heat-conductive metal-based foam 260 enhances the thermal conductivity of the polymer-based heat pipe 200 to enhance heat transfer in the condensation area and the evaporation area. In addition, it can further increase the structural rigidity of the polymer-based heat pipe 200. The combination of elongated ridges 241 and microchannels 242 provides the wicking structure 240 to the polymer-based heat pipe 200. In an embodiment wherein the wicking structure 240 is not provided by heat-conductive metal-based foam 260 protruding in the closed working fluid chamber 230, as will be described in more details below, and heat-conductive metal-based foam 260 is included inside at least some of the walls 220 of the polymer-based housing to enhance the thermal conductivity of the polymer-based heat pipe 200, heat-conductive metal-based foam 260 can be provided solely in the condensation area and the evaporation area of the polymer-based heat pipe 200 with the intermediate section, i.e. the section extending between the condensation area and the evaporation area being free of heat-conductive metal-based foam 260 embedded within the housing.

It is appreciated that, in an alternative embodiment (not shown), the heat-conductive metal-based foam 260 embedded in the housing walls 220*a-d* can be replaced by other types of heat-conductive metal or ceramic insert(s) such as, and without being limitative, metal or ceramic particles to increase the thermal conductivity of the housing walls 220*a-d*.

In the embodiments wherein the housing walls 220*a-d* include at least partially embedded heat-conductive metal-based foam 260 (or heat-conductive metal or ceramic), support posts maintaining a gap within the working fluid chamber are not compulsory since the heat-conductive metal-based foam 260 (or heat-conductive metal or ceramic) increase the structural rigidity of the polymer-based heat pipe. In some implementations, support posts can be provided in the working fluid chamber 230 in combination with at least partially embedded heat-conductive metal-based foam 260 at least partially embedded in the housing walls 220*a-d* to further enhance the structural rigidity.

Figure 13:
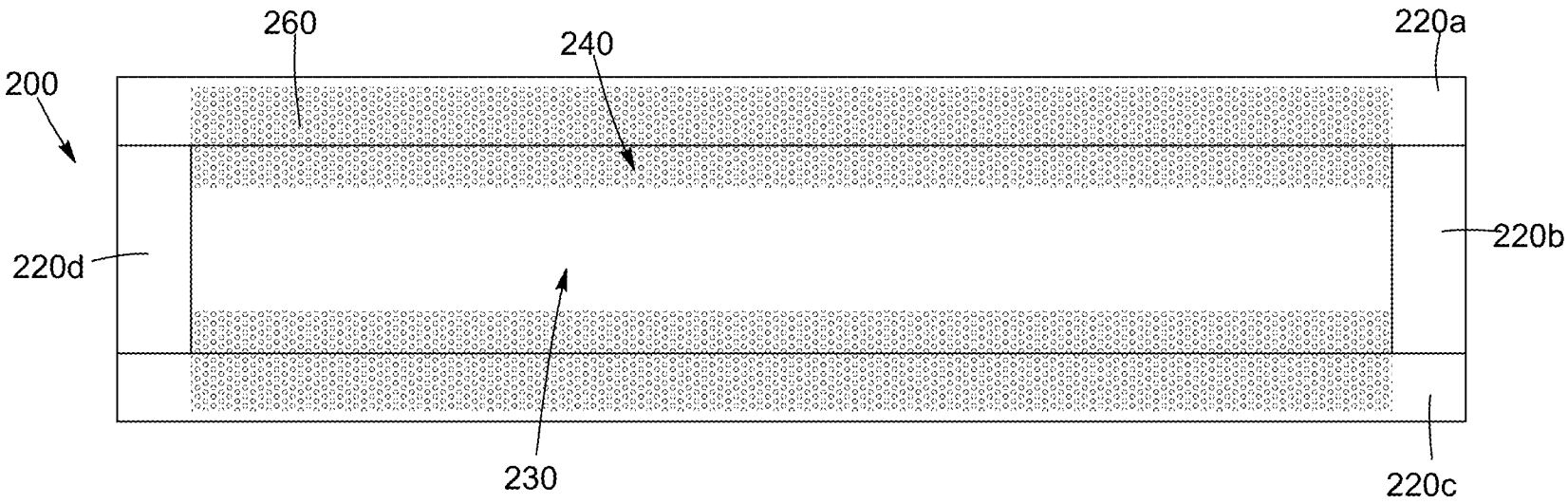
FIG. 13 is a schematic diagram sectional view of a polymer-based heat pipe including the housing wall shown in FIG. 12, in accordance with an embodiment.
Figure 14:
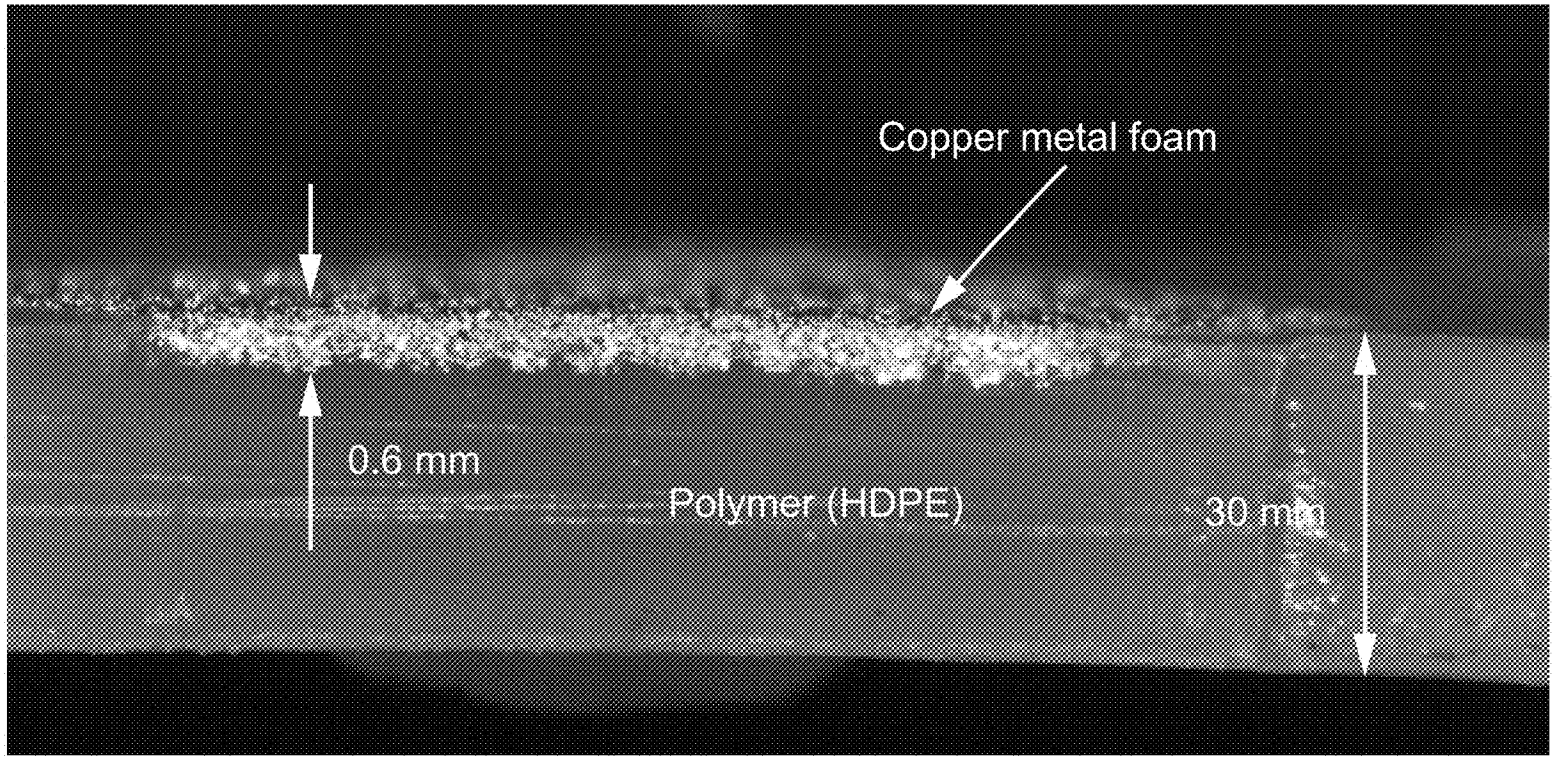
FIG. 14 is a microscopic side view, enlarged, of the housing wall of a heat pipe fabricated in accordance with the embodiment shown in FIG. 12.
Figure 15:
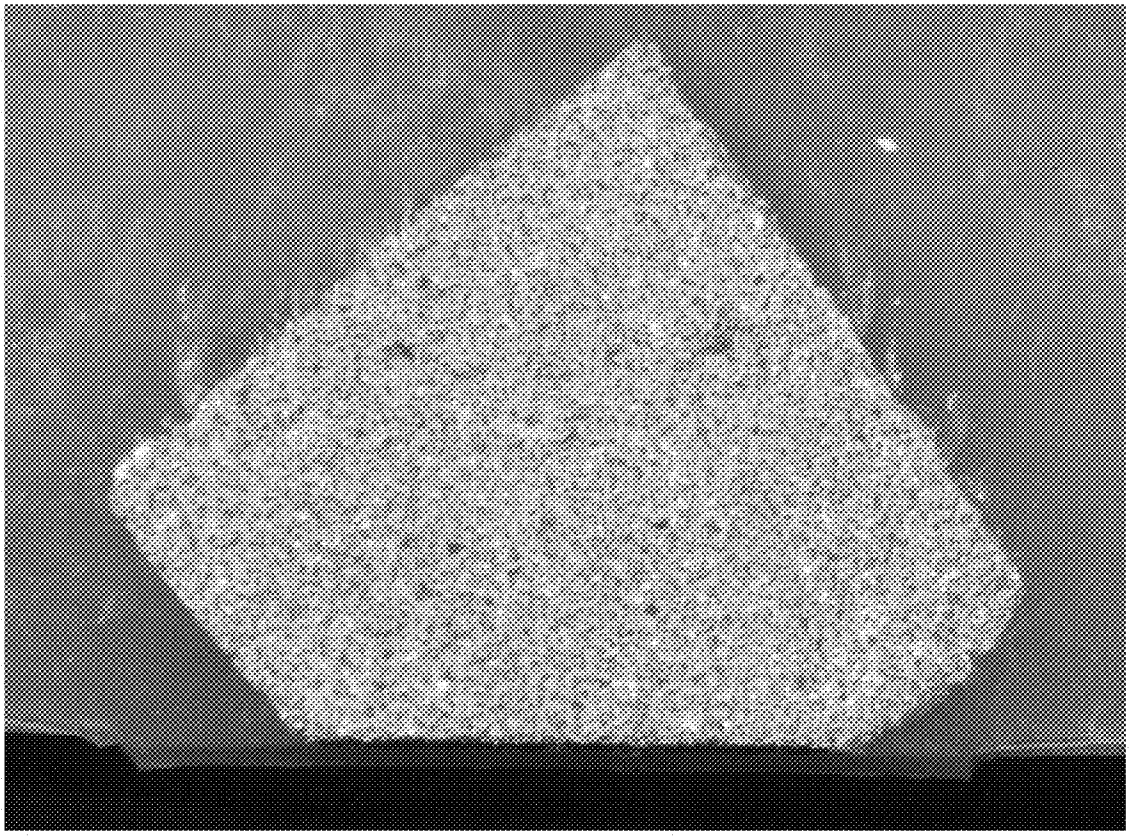
FIG. 15 is a microscopic top view, enlarged, of the housing wall of the heat pipe fabricated in accordance with the embodiment shown in FIG. 12.

In the embodiment shown in FIGS. 12 and 13, the wicking structure 240 is provided by a portion of the heat-conductive metal-based foam 260 extending in the closed working fluid chamber 230. A portion of the heat-conductive metal-based foam 260 is embedded in the housing walls 220 to enhance the thermal conductivity of the polymer-based heat pipe 200, and, optionally, the structural rigidity. The portion of the heat-conductive metal-based foam 260 extending in the closed working fluid chamber 230 has an open porosity to define fluid channels therein, i.e. its pores are not filled with polymer as the portion embedded within the housing wall(s).

In a non-limitative embodiment, the thickness of the heat-conductive metal-based foam 260 extending in the closed working fluid chamber 230 can range between about 0.1 mm and about 1 mm.

Figure 16:
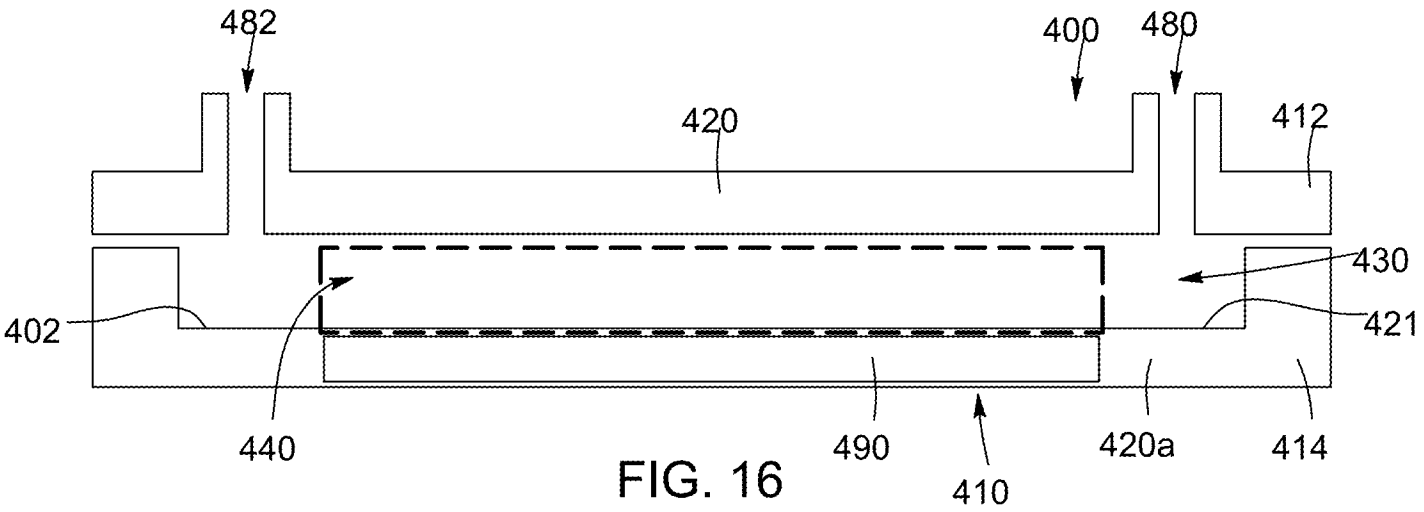
FIG. 16 is a schematic sectional view of a polymer-based heat transfer device, and more particularly, a cold plate according to a possible embodiment wherein an inner surface of a polymer-based housing includes a conductive wall insert and a grooved structure as a porous structure.
Figure 17:
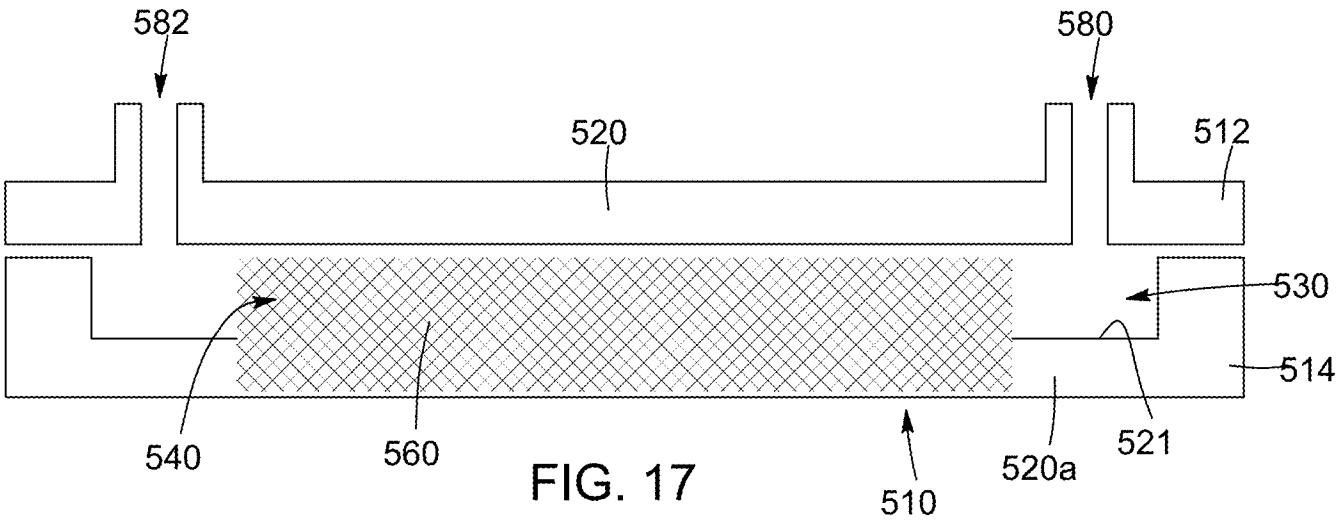
FIG. 17 is a schematic sectional view of a cold plate according to another possible embodiment wherein an inner surface of a polymer-based housing includes a conductive porous medium as a porous structure.

Turning now to FIGS. 16 and 17, there are shown two different implementations of the polymer-based heat transfer device wherein the heat transfer device is a cold plate. The configuration of the heat transfer device for cold plates is substantially similar to the one described hereinabove in reference to heat pipes, except that cold plates circulate a liquid that collects heat wherein no phase change occurs. Furthermore, it requires the addition of inlet and outlet ports to the polymer-based housing, which are operatively connectable to a pump and a heat rejection device, such as a radiator. More particularly, when operatively connected to the pump and the heat rejection device, the cold plate is in liquid communication therewith.

Inside the working chamber of the cold plate, the working fluid, i.e. the working liquid, circulates inside a porous structure, which can include a plurality of microchannels or a porous material, to collect the heat. However, as opposed to the heat pipe, it does not use capillary forces to circulate the fluid since it only contains liquid. Therefore, a cold plate does not include a vapor core.

The microchannels can be provided on one housing wall or a plurality thereof. In an implementation, the microchannels are provided on the inner surface of one housing wall and the inner surface of the opposite housing wall is substantially flat (or planar). The ridges defining the microchannels contact with (or are adjacent to) the flat inner surface of the opposite housing wall to cap them and define the microchannels inbetween. In this implementation, the ridges contacting the opposite housing wall act as housing wall spacers, similar to the support posts 150, to maintain the two opposed ones of the housing walls in a spaced-apart configuration with the working chamber extending inbetween. More particularly, the ridges defining the microchannels extend between the two opposed ones of the housing walls.

As for the above-described heat pipes, in one implementation, the cold plate can also include a heat-conductive porous material, such as a metal-based heat-conductive porous material, at least partially embedded into one or more housing walls. In one embodiment, the porous material can be embedded in a section of the cold plate housing in contact with or in proximity to the heat source to increase the heat conduction of the cold plate. As mentioned above, embedding heat conductive material into the housing walls allow heat to efficiently conduct through the wall into the flow.

As for the above-described heat pipes, the working fluid for the cold plate may be water. Alternatively, the working fluid could be, for example, refrigerant (e.g. R134a), ammonia, methanol, water and ethylene glycol mixture or acetone. It will be understood that the working fluid 170 is selected so as to be compatible with the material forming the porous structure, and may, accordingly, vary from one application to another.

Referring now to FIG. 16, in a first implementation, the polymer-based cold plate 400 includes a polymer-based housing 410 having housing walls 420 with one of them 420*a* having a porous structure 440 provided thereon, on an inner surface 421 thereof. As for the above-described heat pipes, the inner surfaces 421 of the housing walls 420 define a working fluid chamber 430. In the illustrated variant, only one 420*a* of the housing walls 420 includes a porous structure 440. In alternative embodiments (not shown), more than one of the housing walls 420 can have a porous structure. The porous structure 440 is located inside the working fluid chamber 430.

The housing 410 of the polymer-based cold plate 400 includes a working liquid inlet and outlet ports 480, 482 allowing introduction and withdrawal of the working liquid in and from the working fluid chamber 430. In the embodiment shown, the working liquid inlet and outlet ports 480, 482 are located on the housing walls 420 opposed to the one 420*a* provided with the porous structure 440, at opposed ends thereof. However, it is appreciated that the configuration of the liquid inlet and outlet ports 480, 482 can vary from the embodiment shown in FIG. 16.

As mentioned above, the liquid inlet and outlet ports 480, 482 are operatively connectable to a pump to allow liquid circulation and to a heat rejection device to be in liquid communication therewith.

In the embodiment shown in FIG. 16, the porous structure 440 includes a plurality of elongated ridges (or fins), extending substantially parallel to one another and protruding in the working fluid chamber 430 from the housing walls 420*a* and defining inbetween a plurality of microchannels 442 (or elongated grooves) through which the liquid can circulate.

As for the heat pipes, the size, shape and aspect ratio of the porous structure can vary. Similar embodiments to the ones described hereinabove in reference to the heat pipes can be foreseen.

In the embodiment shown in FIG. 16, the polymer-based cold plate 400 also includes one or a plurality of heat-conductive insert 490 embedded with one 420*a* of the housing walls 420. In the embodiment shown, the heat-conductive insert 490 is a metal-based or silicon-based plate inserted and contained into the housing wall 420*a*, extending below the porous structure 440, i.e. substantially aligned therewith. As mentioned above, the heat-conductive insert 490 enhances the heat conductive properties of the polymer-based housing 410.

However, in alternative embodiments, it is appreciated that the polymer-based cold plate 400 can be free of the heat-conductive insert. Alternatively, the polymer-based cold plate 400 can include more than one heat-conductive insert. Furthermore, the position and/or configuration of the heat-conductive insert can vary from the embodiment shown. For instance, it does not necessarily extend below the porous structure 440 or it is not necessarily substantially aligned therewith.

As for the porous structure 140, the porous structure 440 may be formed directly onto the housing wall 420. Alternatively, the porous structure 440 could be progressively added (such as by additive manufacturing) or mounted onto the housing wall 420. The microchannels can be etched or machined on the inner surface 421 of the housing walls 420 to create an enhanced heat exchange surface with the working fluid. In this case, the microchannels and housing walls are one single piece.

As for the heat pipes, in the non-limitative embodiment shown, the housing 410 includes a first housing shell 412 and a second housing shell 414 superposed to one another and sealed together, with the housing shell 414 including the porous structure 440 on an inner side 402 thereof. Alternatively, the polymer-based housing 410 may comprise a plurality of housing shells, i.e. two or more, that could be assembled together to form the polymer-based cold plate 400.

The size, shape, and configuration of the shells 412, 414, fluid chamber 430, and the elongated microchannels 442 can be similar to the ones described above in reference to the heat pipes.

Turning now to FIG. 17, a second implementation of a polymer-based cold plate 500 will be described. The polymer-based cold plate 500 is substantially similar to the polymer-based cold plate 400 described hereinabove in reference to FIG. 16, except that the combination of heat-conductive insert 490 and porous structure 440 including a plurality of elongated microchannels 442 is replaced by a porous material partially embedded in one 520*a* of the walls 520 of the polymer-based housing 510. The porous material has a portion protruding from an inner surface 521 of the housing wall 520*a* and into the working fluid chamber 530. The portion of the porous material protruding in the working fluid chamber 530 defines the porous structure 540, which has an open porosity to define fluid channels therein, i.e. its pores are not filled with polymer as in the portion embedded within the housing wall(s).

In the implementation shown, the porous material comprises a heat-conductive metal-based foam 560 embedded within the housing wall 520*a*. As for the heat pipes, embedding heat-conductive metal into the housing walls 220*a* increases the thermal conductivity and the structural properties of the polymer-based cold plates 500.

The heat-conductive metal-based foam 560 can contact with (or are adjacent to) the flat inner surface of the opposite housing wall to act as housing wall spacers, similar to the support posts 150, to maintain the two opposed ones of the housing walls in a spaced-apart configuration with the working chamber extending inbetween.

As for the heat pipes, the heat-conductive material for the cold plate 500 can be chosen to have a similar thermal expansion coefficient to the heat source to which it will be coupled to allow a solid (welded) interface between the heat source and the heat-conductive material. The heat-conductive material for the cold plate can be similar to those enumerated above in reference to the heat pipes. For example, and without being limitative, the heat-conductive material could be: copper, steel, titanium, aluminum, silicon, germanium, superalloys, or any other materials having the required properties listed above. Alternatively, the housing walls 520 can comprise other structural elements to provide more rigidity to the polymer-based cold plate 500. For highest rigidity and wall thermal conductivity, rigid and heat-conductive inserts, such as insert 490, can be embedded in the housing walls 520.

As for the embodiment of the cold plate described hereinabove in reference to FIG. 16, the cold plate of FIG. 17 includes a polymer-based housing 510 made of two shells 512, 514, one of them including working liquid inlet and outlet ports 580, 582 operatively connectable to a pump and a heat rejection device (not shown).

According to one embodiment, the hermeticity of the polymer-based heat transfer devices, either a heat pipe, a cold plate or a vapor chamber, as described in the present description may be ensured by decreasing the vapour transmission rate (WVTR). For example, the WVTR can be decreased by adding a high barrier coating layer comprising a single layer or a multilayer film. For example, and without being limitative, the high barrier coating layer may be formed from or comprise indium tin oxide (ITO). Optionally, ITO may be deposited using plasma-enhanced chemical vapor deposition (PECVD). Yet optionally, an inorganic layer may further be deposited on the ITO. For example, an aluminum oxide ($Al_2O_3$) layer can be deposited by atomic layer deposition (ALD). Yet optionally, a protective layer may further be deposited using PECVD. For example, and without being limitative, $SiO_x$ or $SiN_x$ can be deposited using PECVD to act as the protective layer. The aluminum oxide ($Al_2O_3$) layer can also be protected from direct contact with water by 10 to 40 microns copper deposited by electroplating. The electroplated copper can also protect thin and brittle aluminum oxide ($Al_2O_3$) layer in the multi-film against stresses caused by CTE mismatch.

In one embodiment, the three layers (organic, inorganic and protective layers) that have been previously described could be deposited directly on a surface of the HDPE. In this configuration, the organic sublayer (e.g. ITO) may be useful to reduce the coefficient of thermal expansion mismatch between HDPE substrate and the inorganic layer to be deposited. The inorganic layer (e.g. $Al_2O_3$), acting as a barrier layer, can react with water and generate non-condensable gases, so a protective layer is required to prevent the direct contact of water with $Al_2O_3$.

According to one embodiment, the high barrier coating layer may be deposited on a surface of the porous structure, meaning that the high barrier coating layer may be comprised inside of the polymer-based heat transfer device. Alternatively, for example, when the heat-conductive metal-based foam defines the porous structure, the high barrier coating layer may be deposited on an outside surface of the polymer-based heat transfer device.

According to one embodiment, at least a portion of one inner surface of the housing walls is hydrophilic. In the embodiments wherein the porous structure is defined by a combination of elongated ridges and microchannels, a top portion of the porous structure may be hydrophobic. Yet optionally, a bottom portion of the porous structure, such as a bottom portion of the microchannels, may be hydrophilic to promote fluid flow between the condensation area and the evaporation area or between the working fluid inlet and outlet ports. For instance, and without being limitative, a polymeric surface can be made hydrophilic by plasma treatment of the exposed inner surfaces of the housing walls (either the polymer of the polymer-based heat transfer device or a metal coating applied thereon).

A metal coating can be applied on at least a portion of the inner surfaces of the housing walls to enhance the hydrophilicity and/or the gas barrier properties. For instance, a thin metal film of 10 to 40 microns, such as copper or chrome, can cover at least a portion thereof.

According to one embodiment, the first and second housing shells are sealed along their perimeter. Optionally, the first and second housing shells can be bonded together using ultrasonic plastic welding to produce hermetic joints. Alternatively, and without being limitative, laser plastic welding and high vacuum epoxies can be used for bonding the first housing shell with the second housing shell. Alternatively, ultrasonic metal welding can also be used to bond the first metalized polymeric housing shell with the second housing shell to create hermetic joints.

In accordance with another aspect, a process for manufacturing a polymer-based heat transfer device as the one described in the present description is provided.

Generally described, the manufacturing process for manufacturing the polymer-based heat transfer device comprises the steps of: forming a first polymer-based housing shell and a second polymer-based housing shell; superposing the first housing shell and the second housing shell; at least partially peripherally sealing the first housing shell and the second housing shells together; and inserting a working fluid inside the working fluid chamber. The porous structures manufactured from this process can be tailored and adapted, which may help to adapt the use of the polymer-based heat, as presented in the previous description, to the specifications encountered by one skilled in the art, such as: the heat flux patterns expected from the heat source, as well as tailoring of the capillary forces according to the pressure drop in the porous structure in case of a heat pipe. This process also allows to manufacture a polymer-based heat transfer device comprising a piece of conductive porous material such as copper metal foam to enhance its heat transfer properties.

In one embodiment, the manufacturing process may use plastic fabrication methods, such as, but without being limited to: injection molding, stamping and/or additive manufacturing such as tridimensional printing (3D printing) to form a polymer-based housing or, alternatively, each one of the first and second housing shells. As mentioned above, microchannels can be etched or machined on an inner side of one or more housing walls to create an enhanced heat exchange surface with the working fluid.

In one embodiment, an aluminum mold may be injected with melted plastic (e.g. polymer) so as to reproduce tridimensional structures (such as a porous structure and/or a curved or bent heat transfer device geometry) having various shapes, dimensions, size and aspect ratio on the housing wall of the polymer-based heat transfer device. The use of an injecting method advantageously allows to create almost any pattern, shape or distribution with a reproducible process.

In regard to the step of forming a first polymer-based housing shell and a second polymer-based housing shell, it may comprise the step of forming a porous structure on at least one inner surface of the first and second inner shells. For example, the forming step may comprise the step of injecting plastic/polymer in a mold. Optionally, a metal foam may be placed in the mold prior to the polymer injection. The injected liquid polymer will enter into the pores of the foam, partially or completely through its thickness. When the polymer completely fills the foam pores through its entire thickness, the metal foam becomes embedded into the housing wall(s), as described above, for increased thermal conductivity and/or mechanical strength. When only part of the foam thickness is filled by the injected liquid plastic/polymer, the thickness filled with the polymer will be embedded in the housing wall(s) for increased thermal conductivity and/or mechanical strength, whereas the thickness that is not filled by the polymer will provide the porous structure. This non-filled side will face the inside of the heat transfer device, facing the opposing shell. Metal foam is typically used when one is required to manufacture a polymer-based heat transfer device for applications that require higher wall thermal conductivity and structural rigidity, as it has been previously presented. Such configuration could also be used for high heat transfer rate applications that require higher evaporation and porous rates. Other alternatives to the injection molding methods comprise, but are not limited to, stamping, 3D printing, additive method, subtractive method, or any other method allowing to create patterns onto the first and/or second polymer-based housing shells.

In regard to the step of superposing the first housing shell and the second housing shell, it may comprise assembling the first and second housing shells with the surfaces facing one another. The step of superposing the first and second housing shells may further comprise the step of maintaining a gap between the two surfaces, so that they remain spaced-apart and define a working fluid chamber for the vapor. In case of a cold plate, superposing the first and second housing shells may further comprise the step of juxtaposing, and even contacting, a top surface of ridges protruding from an inner surface of one of the housing shells to an inner surface of an opposed one of the housing shells. Optionally, the steps of superposing and assembling the first and second housing shells may further comprise the step of aligning the first housing shell with the second housing shell. The step of aligning the first and second housing shells may comprise marking at least one of the first and second housing shells with a marking means selected from the group consisting of a pen, a laser, an engraving, an etching, a print, a carving, a molded protrusion or recess, a laser, an illumining device and a projection. As it will be readily understood, the marking means comprise but are not limited to methods and/or means of physically, superficially and/or temporarily/permanently marking the first and second housing shells so as to facilitate their alignment during the assembling step.

In regard to the step of peripherally sealing the first housing shell and the second housing shell, it may comprise the step of bonding the first and second housing shells together using ultrasonic plastic welding, ultrasonic metal welding, laser plastic welding, thermoforming, glue, high vacuum epoxies or any other methods and/or allowing to peripherally seal the first and second housing shells together.

In one embodiment, the step of peripherally sealing the first and second housing shells may comprise the step of removing gas, such as air and/or any other non-condensable gases, from the working fluid chamber.

In regard to the step of inserting the working fluid inside the working fluid chamber, for a heat pipe, it may comprise the step of using and inserting a small tube into an injection hole provided on one side of the polymer-based heat transfer device or in a trench formed through the joint between the two shells. Optionally, the small tube can be cut after injecting the working fluid within the closed working fluid chamber. Yet optionally, the injection hole may be sealed to avoid the working fluid from leaking from the sealed polymer-based-heat transfer device.

According to one embodiment, for a heat pipe, the step of inserting the working fluid inside the working fluid chamber may comprise a step of creating a vacuum in the polymer-based heat transfer device.

According to one possible embodiment, for a heat pipe, the step of sealing the injection hole may comprise the step of adding a sealant, a melted drop, a plastic joint, silicone, any polysiloxane-based compounds, cold welding using a pinch-off tool, combination thereof, or any other material allowing to seal the injection hole.

According to one possible embodiment, the process may further comprise a step of applying a coating on the inside surface of the polymer-based heat transfer device for impermeability and/or hydrophilicity of the inner surfaces. Optionally, the coating can act as a high barrier coating layer and can help enhance the hermeticity of the polymer-based heat transfer device. Alternatively or in addition, the high barrier coating layer can be applied on an outside surface of the polymer-based heat transfer device.

According to one possible embodiment, the process may further comprise a step of treating an internal surface of the polymer-based heat transfer device with a plasma treatment to increase the hydrophilicity property of the surface. Alternatively, the hydrophilicity of a portion or an entirety of an interior surface of the polymer-based heat transfer device may be increased by adding hydrophilic coatings.

Figure 18:
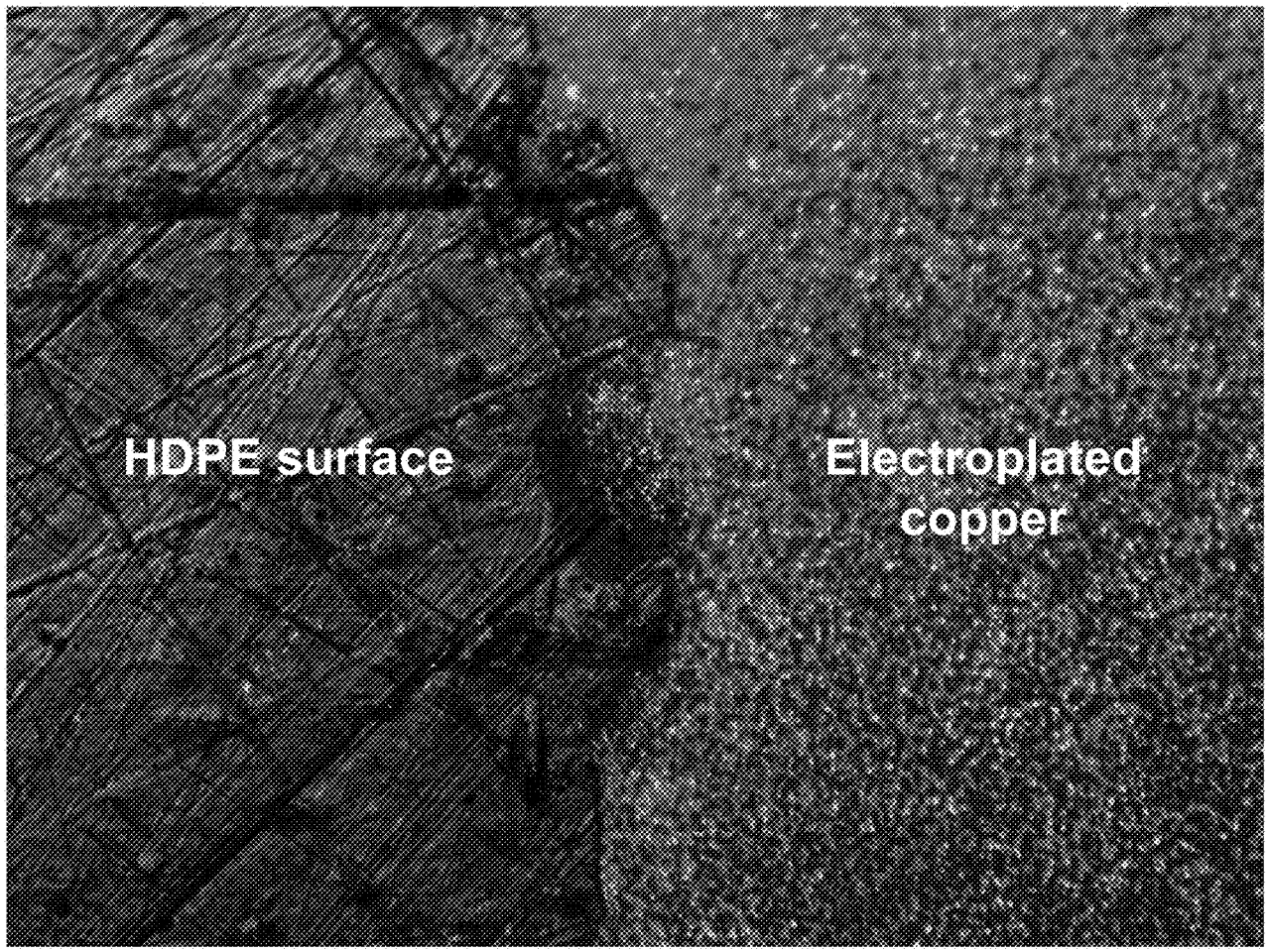
FIG. 18 is a microscopic top view, enlarged, of a polymeric surface covered by an impermeable metal-based layer according to a possible embodiment.

According to one possible embodiment and as shown on FIG. 18, the process may comprise a step of electroplating a metal layer onto a surface of the polymer-based heat transfer device. Optionally, a metal seed layer including chrome and copper may be deposited on the housing walls of the polymer-based heat transfer device prior to the step of electroplating the metal layer. Yet optionally, the metal seed layer may be deposited by physical vapor deposition (PVD) method. A copper electroplating may then be employed to deposit a copper layer on the inner surface of the heat transfer device. This step is aimed at making the surface of the housing walls hydrophilic, and increasing the gas barrier properties. Optionally, and if the polymer-based heat transfer device is required to have a better hermeticity, the step of electroplating the surface of the polymer-based heat transfer device may further comprise the step of adding thin layers of high barrier plastics. Optionally, the plastic may be ethylene vinyl alcohol (EVOH). Alternatively, the plastic could be any ethylene and/or vinyl alcohol-based polymer having the required hydrophilicity properties. Optionally, the metal layer and the plastic layer may be bonded together using a laser, ultrasonic treatment or an epoxy to produce hermetic joints.

Figure 19:
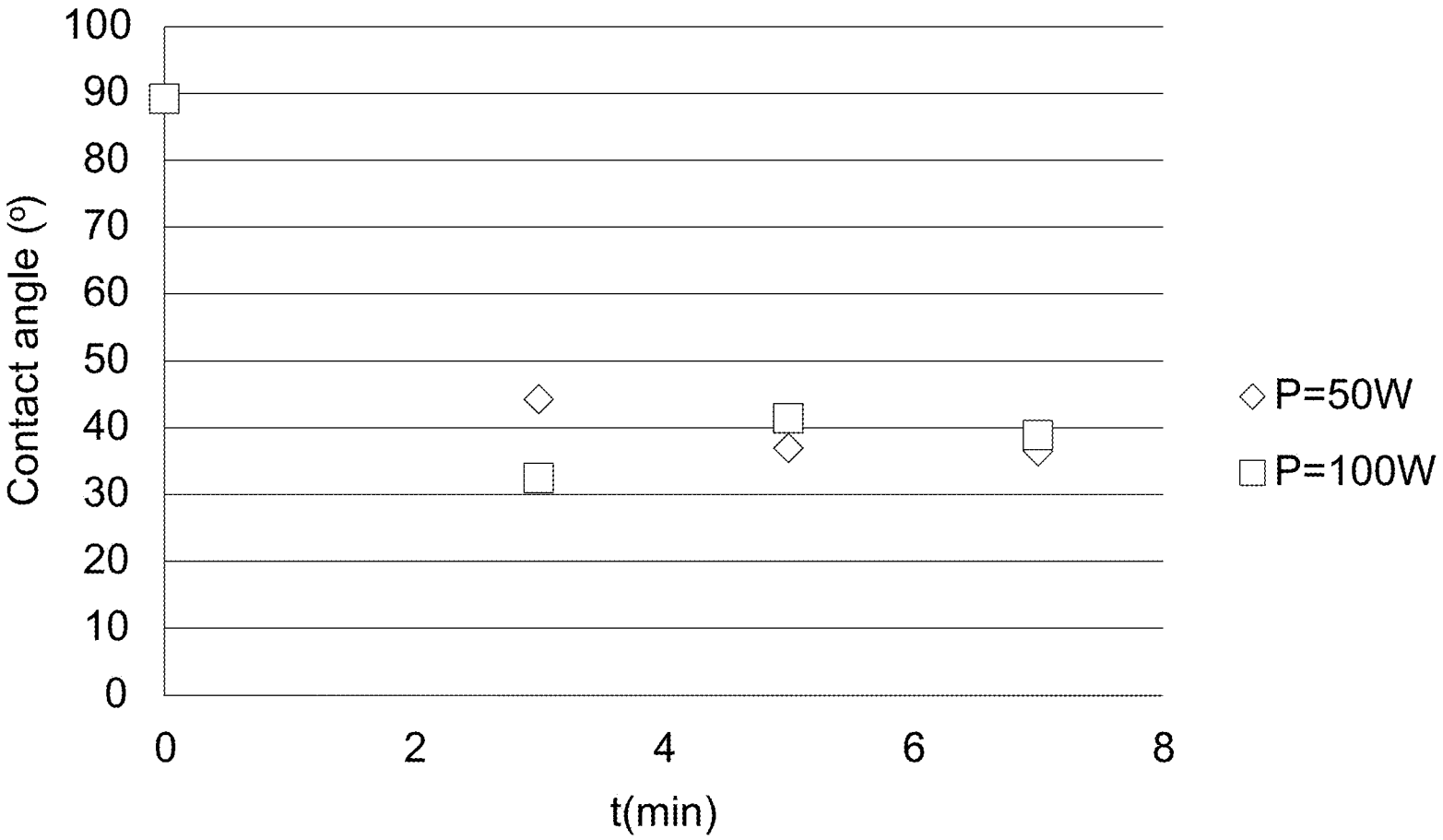
FIG. 19 is a graph showing effect of an oxygen plasma treatment on a water contact angle for a polymeric surface.

According to one possible embodiment, the process may comprise a step of treating a portion or an entirety of a surface of the housing walls and/or the porous structure with a plasma for reducing the working liquid contact angle. For example, the surface may be treated with an oxygen plasma so as to reduce the contact angle of the water on the HDPE surface, as shown in FIG. 19. In another example, the hydrophilic coating is created by attaching chemical molecules on the surface as a self-assembled monolayer (SAM), such as APTES or other organosilanes.

Figure 20:
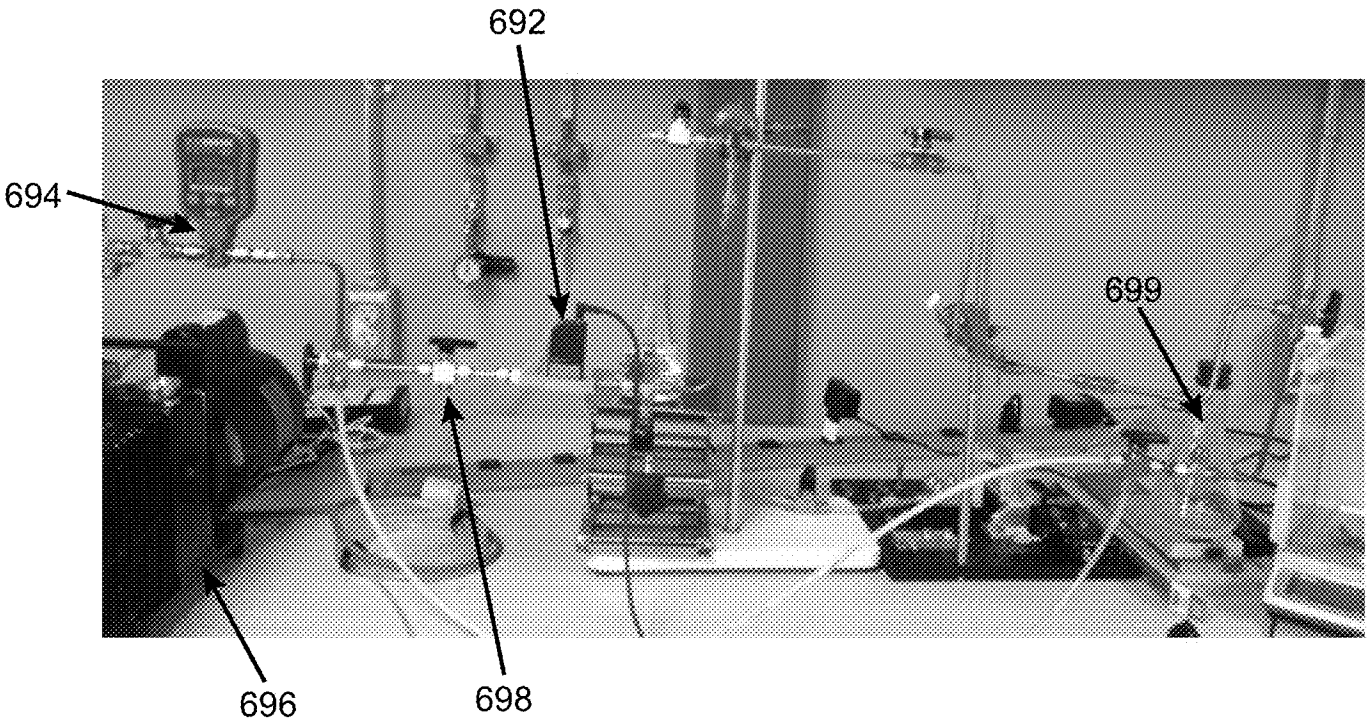
FIG. 20 is a photograph showing a charging station for a polymer-based heat pipe according to a possible embodiment.

According to one possible embodiment for a heat pipe shown on FIG. 20, the steps of creating the vacuum and inserting the working fluid can be achieved with an integrated charging station. For example, the charging may allow to insert precise amounts of the working fluid (e.g. 2 to 2.5 mL) and creating a vacuum up to approximately 1 mTorr. In the embodiment shown, the charging station includes, amongst others, a flow meter 692, a vacuum gauge 694, a vacuum pump 696, a heat pipe connection 698, and a liquid trap 699.

Figure 21:
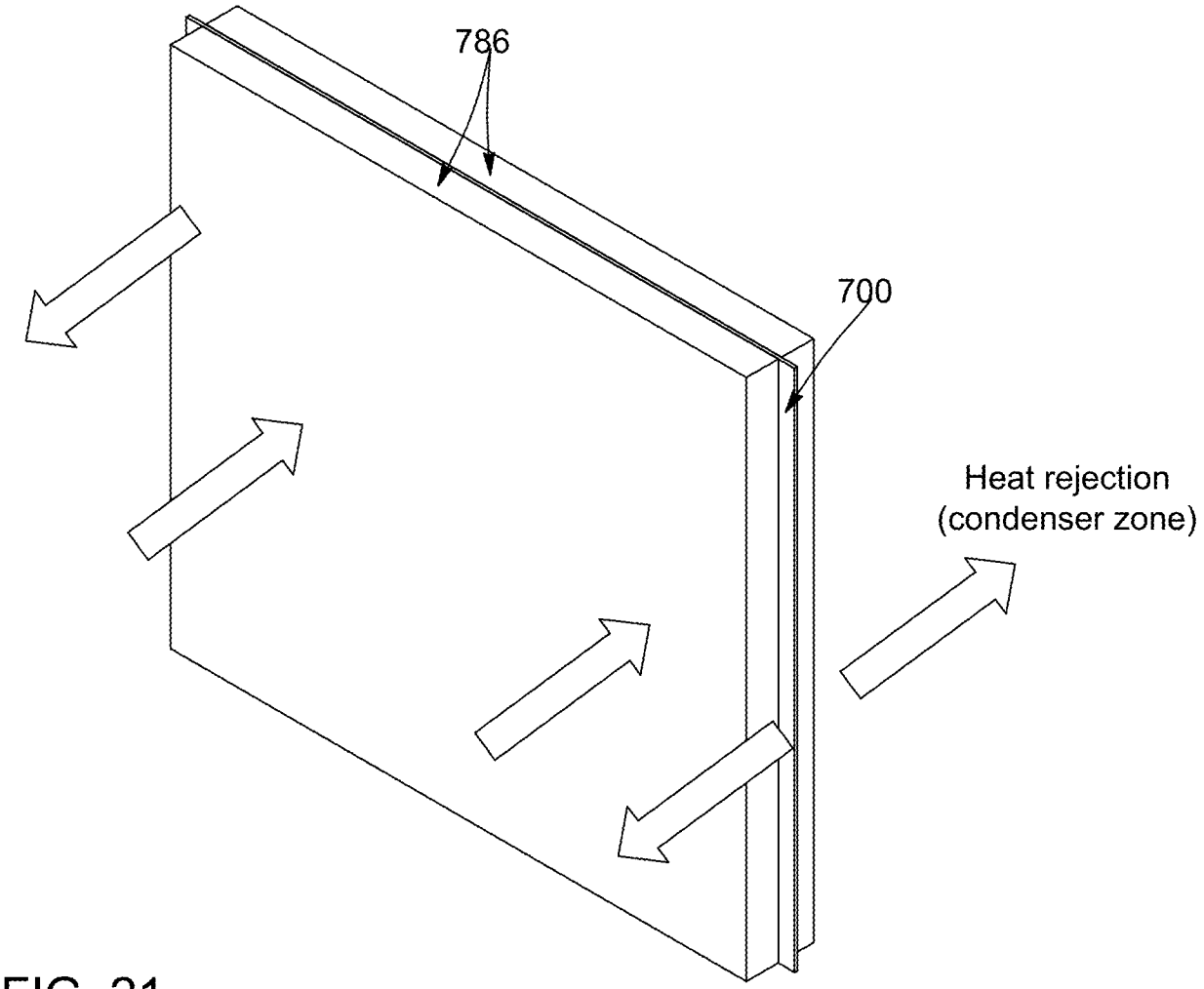
FIG. 21 is a schematic representation of an application of a polymer-based heat transfer device for electric and hybrid vehicles, according to a possible embodiment.

According to one possible embodiment illustrated on FIG. 21, the polymer-based heat transfer device 700 as described in the present description may be used in batteries 786 for electric or hybrid vehicles, for example for extracting heat from Li-ion batteries 786. In the embodiment shown, the heat transfer device 700 is a heat pipe. However, in an alternative embodiment (not shown), it could be a cold plate including a housing with working fluid inlet and outlet ports.

Figure 22:
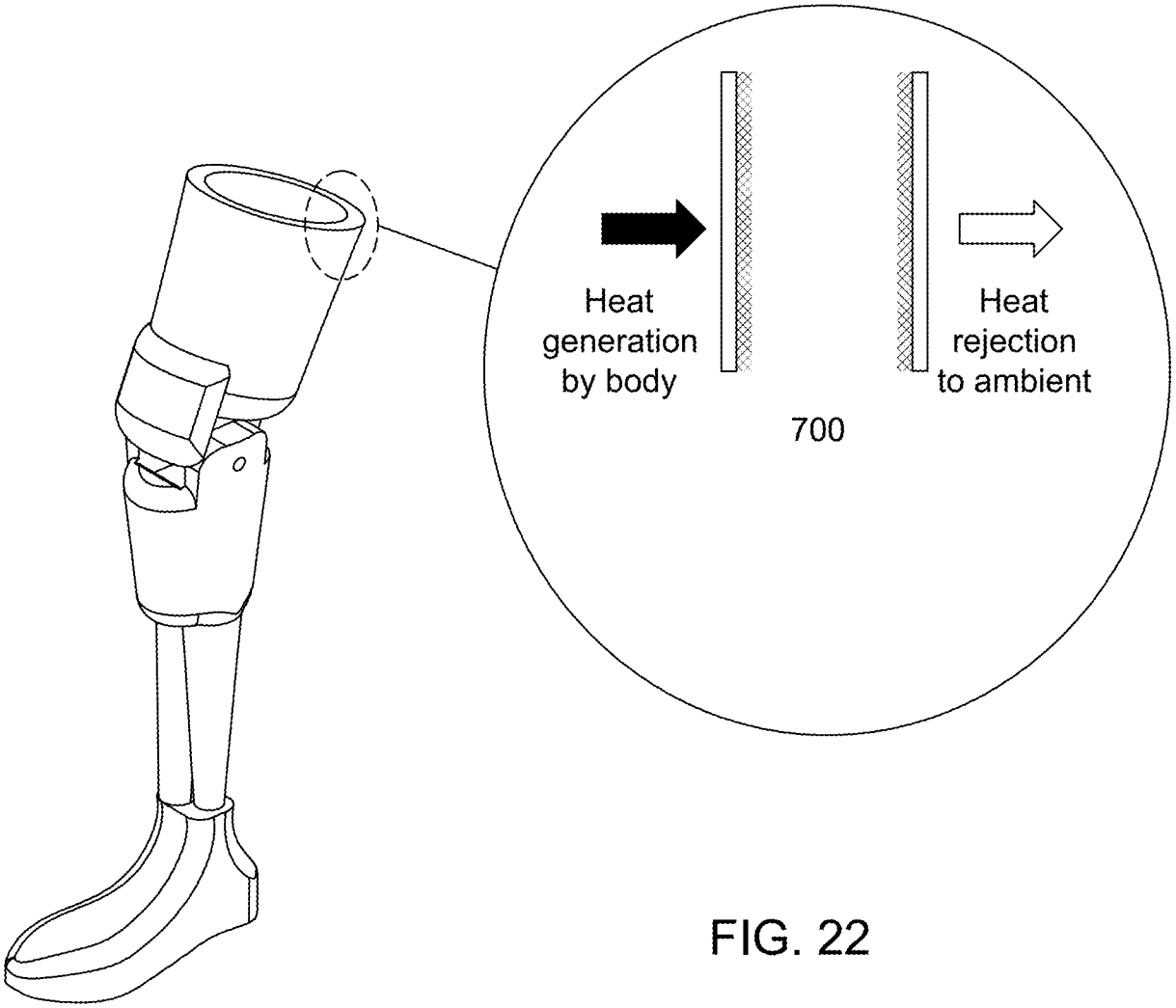
FIG. 22 is a schematic representation of an application of a polymer-based heat transfer device for prosthesis systems, according to a possible embodiment.

According to one possible embodiment illustrated on FIG. 22, the polymer-based heat transfer device 700 as described in the present description may also be used in prosthesis systems, for example for ejecting metabolic heat out of a body portion.

In summary, the polymer-based heat transfer devices described above can be advantageous over prior art heat transfer devices for their performance, relatively low cost, and light weight. On a general aspect, they are compatible with a broad variety of electronic packaging methods and are electrically insulating.

The polymer-based heat transfer devices described above can be also advantageous for a manufacturer, since the production of the polymer-based heat transfer devices as defined in the present description relies on more flexible fabrication methods, hence allowing the formation of various shape factors according to one's needs.

The manufacturing process described above can be used to directly form the plastic casing or electrical/electronic equipment, machines or other products that benefit from enhanced cooling and heat removal. The product casing with embedded heat transfer device would substantially efficiently distribute the heat from the internal heat source to the entire or a large portion of the outer surface of the product. This will help reject heat to the ambient air and reduce the temperature of the product.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A heat transfer device comprising:

a housing having a heat-conducting wall in heat-transfer communication with a working fluid chamber, the heat-conducting wall having a wall body extending from an inner face to an opposed outer face, the wall body at least partially formed of a first material, the first material including a polymer, and a heat-conductive insert being porous and formed of a second material defining porosities therein, at least a portion of the heat-conductive insert being embedded in the wall body between the inner face and the outer face, the first material filling the porosities of said at least a portion of the heat-conductive insert, the second material having a thermal conductivity greater than that of the first material.

2. The heat transfer device according to claim 1, wherein the heat-conductive insert extends from the inner face into the working fluid chamber, the heat-conductive insert defining a porous structure into the working fluid chamber.

3. The heat transfer device according to claim 1, wherein an entirety of the heat-conductive insert is entirely embedded in the wall body of the heat conducting wall.

4. The heat transfer device according to claim 1, comprising spaced-apart spacers protruding from the heat-conducting wall into the working fluid chamber, the spacers extending from the heat-conducting wall to another wall of the housing opposite the heat-conducting wall.

5. The heat transfer device according to claim 3, further comprising a plurality of spaced-apart ridges protruding from the heat-conducting wall into the working fluid chamber and extending substantially parallel to one another and defining a plurality of microchannels between the ridges, the ridges extending towards another wall of the housing opposed the heat-conducting wall.

6. The heat transfer device according to claim 1, wherein another portion of the heat-conductive insert at least partially extends in the working fluid chamber.

7. The heat transfer device according to claim 5, wherein a bottom surface of the microchannels is hydrophilic and a top surface of the microchannels is hydrophobic.

8. The heat transfer device according to claim 1, wherein the heat-conductive insert is a heat-conductive foam made of a metallic material or of a ceramic material.

9. The heat transfer device according to claim 6, wherein the heat-conductive insert has a first portion embedded within the heat-conductive wall and a second portion extending in the working fluid chamber, the porosities of the heat-conductive insert within said at least a portion thereof including first porosities of the first portion, the heat conductive insert having second porosities within the second portion, the second porosities being free of the first material.

10. The heat transfer device according to claim 9, wherein the heat-conductive insert includes a heat-conductive foam.

11. The heat transfer device according to claim 1, comprising an inlet and an outlet both in fluid flow communicating with the working fluid chamber, the inlet connected to a source of a working fluid, a porous structure extending within the working fluid chamber at least between the inlet and the outlet.

12. The heat transfer device according to claim 11, wherein the porous structure is defined by another portion of the heat-conductive insert protruding from the heat-conducting wall into the working fluid chamber.

* * * * *